US006996533B2

(12) United States Patent
Ikeda et al.

(10) Patent No.: US 6,996,533 B2
(45) Date of Patent: Feb. 7, 2006

(54) INFORMATION PROCESSING SYSTEM

(75) Inventors: Keiichi Ikeda, Obihiro (JP); Yoshimichi Osaka, Obihiro (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 08/991,881

(22) Filed: Dec. 16, 1997

(65) Prior Publication Data

US 2001/0044723 A1 Nov. 22, 2001

(30) Foreign Application Priority Data

Mar. 21, 1997 (JP) ..... 9-067620

(51) Int. Cl.
*G10L 13/08* (2006.01)

(52) U.S. Cl. ..... 704/270.1; 704/260; 715/739

(58) Field of Classification Search ..... 704/260, 704/271, 272, 270, 270.1; 709/203, 218; 707/10; 715/542, 739; 345/472.2
See application file for complete search history.

(56) References Cited

U.S. PATENT DOCUMENTS 3,281,959 A * 11/1966 Kobler et al. ..... 345/357
4,685,135 A * 8/1987 Lin et al. ..... 704/260
5,204,947 A * 4/1993 Bernstein et al. ..... 434/230
5,233,333 A * 8/1993 Borsuk ..... 345/156
5,555,343 A * 9/1996 Luther ..... 704/260
5,572,643 A * 11/1996 Judson ..... 709/218
5,699,486 A * 12/1997 Tullis et al. ..... 704/270.1
5,737,395 A * 4/1998 Irribarren ..... 379/88
5,787,254 A * 7/1998 Moddalozzo, Jr. et al. ..... 395/200.58
5,819,220 A * 10/1998 Sarukkai et al. ..... 704/243
5,850,629 A * 12/1998 Holm et al. ..... 704/260
5,884,262 A * 3/1999 Wise et al. ..... 704/270
5,884,266 A * 3/1999 Dvorak ..... 704/275
5,890,123 A * 3/1999 Brown et al. ..... 704/275
5,893,915 A * 4/1999 Cordell et al. ..... 707/513
5,923,885 A * 7/1999 Johnson et al. ..... 395/712
5,953,392 A * 9/1999 Rhie et al. ..... 379/88.13
6,029,135 A 2/2000 Krasle ..... 704/275
6,278,465 B1 * 8/2001 Nielsen ..... 345/472

FOREIGN PATENT DOCUMENTS

WO WO 91/17522 * 11/1991

OTHER PUBLICATIONS

Ronald stephens "A voice for the disabled", New Scientis, vol. 114, Issue 1563,Jun. 4, 1987, pp. 58-61.*
Macintosh Utilities User's Guide; Apple Computer, INC; 1988, pp. 142-145.*

* cited by examiner

*Primary Examiner*—Abul K. Azad
(74) *Attorney, Agent, or Firm*—Staas & Halsey LLP

(57) ABSTRACT

An information processing system receives notice information, having a predetermine format, transmitted via a network. The information processing system includes an extracting unit for analyzing the notice information and extracting character symbol information other than format information included in the notice information based on an analyzing result, a display unit for displaying the notice information using the analyzing result obtained by the extracting unit, and a voice output unit for converting the character symbol information extracted by the extracting unit into voice signals and outputting the notice information by voice based on the voice signals.

24 Claims, 20 Drawing Sheets

FIG. 5

```
<html>
<head>
<title>FEH News Paper index</title>
</head>
<b>FEH News Paper</b><br>
<i>Last updated, Mar. 9 at 18:37 JST.</i>
<br>
<br>
1. <a href="./front.html">ALL-AROUND</a><br>
2. <a href="./polit.html">POLITICS  </a><br>
3. <a href="./econm.html">ECONOMY  </a><br>
4. <a href="./sport.html">SPORT</a><br><b>
<a href="./sport.html"><img src="index030903.gif"></a><br>

</body>
</html>
```

INFORMATION PROCESSING SYSTEM

BACKGROUND OF THE INVENTION (1) Field of the Invention

The present invention generally relates to an information processing system which receives notice information supplied via a network and displays the notice information, and more particularly to an information processing system in which people with an eyesight disorder can easily access the notice information.

(2) Description of the Related Art

Information processing systems connected to a network, such as an internet or an intranet, have recently become popular. In such information processing systems, processes are provided for receiving notice information from a server connected to the network and for displaying the notice information on a display screen. It is necessary to form such information processing systems so that people with an eyesight disorder can also access the notice information easily.

At present, an exclusive WWW browser is needed to access a home page on a WWW (World Wide Web) in the network to read information published on the home page.

However, in many kinds of WWW browsers, display and operations based on a GUI (Graphical User Interface) are adopted. As a result, it is impossible or extremely difficult for people with an eyesight disorder to access the information on the home page on the WWW.

Thus, for people with an eyesight disorder, a browser which is operated based on combined text and voice output software is provided so that the notice information can be accessed. Concretely, in accordance with the following three methods, a home page on the WWW can be accessed.

(1) Method Using Browser Based on Text (a) Method Using Text Browser on Unix

A personal computer is connected to a UNIX server by TELNET and a text browser for the WWW is operated from the personal computer in a line mode. Displayed characters are then read out using the voice output software.

(b) Method Using Text Browser of MS-DOS

Using the text browser of the personal computer, the personal computer is connected to the internet in accordance with the TCP-IP protocol. In the line mode, displayed characters are read out using the voice output software.

(2) Method Using WWW Accessing Function of Personal Computer Communication

A personal computer is connected to a host of a personal computer communication which supplies a display service for home pages based on text, displayed characters are read out using the voice output software.

In a case where information on WWW pages can be heard using the text browser as in the conventional case, the user must operate two individual kinds of software: the text browser and the voice output software.

That is, as shown in FIG. 1, the user specifies a URL (Uniform Resource Locator) which is an address of a WWW page on the network and issues a request for displaying data to the text browser. The WWW page is thus displayed on the screen using the text browser. Next, the user must issue a request for outputting information on the WWW page displayed on the screen by voice.

In addition, in a case where information pages can be heard by connecting to the host of the personal computer communication of the display service for the home pages may be supplied based on the text as in the conventional case. However, the user must perform an operation for connecting a personal computer to such a host of the personal computer communication.

Further, in the conventional case, since only displayed characters are read out, information which is not displayed on the screen is not read out. That is, in a case where link information indicates an address of another WWW page included in contents of the WWW page, the link information is not read out. Thus, in this case, people with an eyesight disorder can not recognize the link information coupling the contents of the WWW displayed on the screen to another WWW page.

In the conventional case, the WWW page is displayed on the screen using a text browser having no function for enlarging characters. It is hard for persons with weak eye sight and older persons to recognize notice information displayed on the screen.

SUMMARY OF THE INVENTION

Accordingly, a general object of the present invention is to provide a novel and useful information processing system in which the disadvantages of the aforementioned prior art are eliminated.

A specific object of the present invention is to provide an information processing system which receives notice information, having a predetermined format and transmitted via a network and displays the notice information and in which people with an eyesight disorder can easily access the notice information.

The above objects of the present invention are achieved by an information processing system which receives notice information, having a predetermined format, transmitted via a network, said information processing system comprising: extracting means for analyzing the notice information and extracting character symbol information other than format information included in the notice information based on an analyzing result; display means for displaying the notice information using the analyzing result obtained by said extracting means; and voice output means for converting the character symbol information extracted by said extracting means into voice signals and outputting the notice information by voice based on the voice signals.

According to the present invention, since the notice information received via the network is displayed and output by voice, people with an eyesight disorder can easily recognize the contents of the notice information.

BRIEF DESCRIPTION OF THE DRAWINGS

Other objects, features and advantages of the present invention will be apparent from the following description when read in conjunction with the accompanying drawings, in which:

FIG. 5 is a diagram illustrating an HTML document;

DESCRIPTION OF THE PREFERRED EMBODIMENTS

First, a description will be given, with reference to FIG. 2, of the principle of an information processing system according to the present invention.

Figure 1:
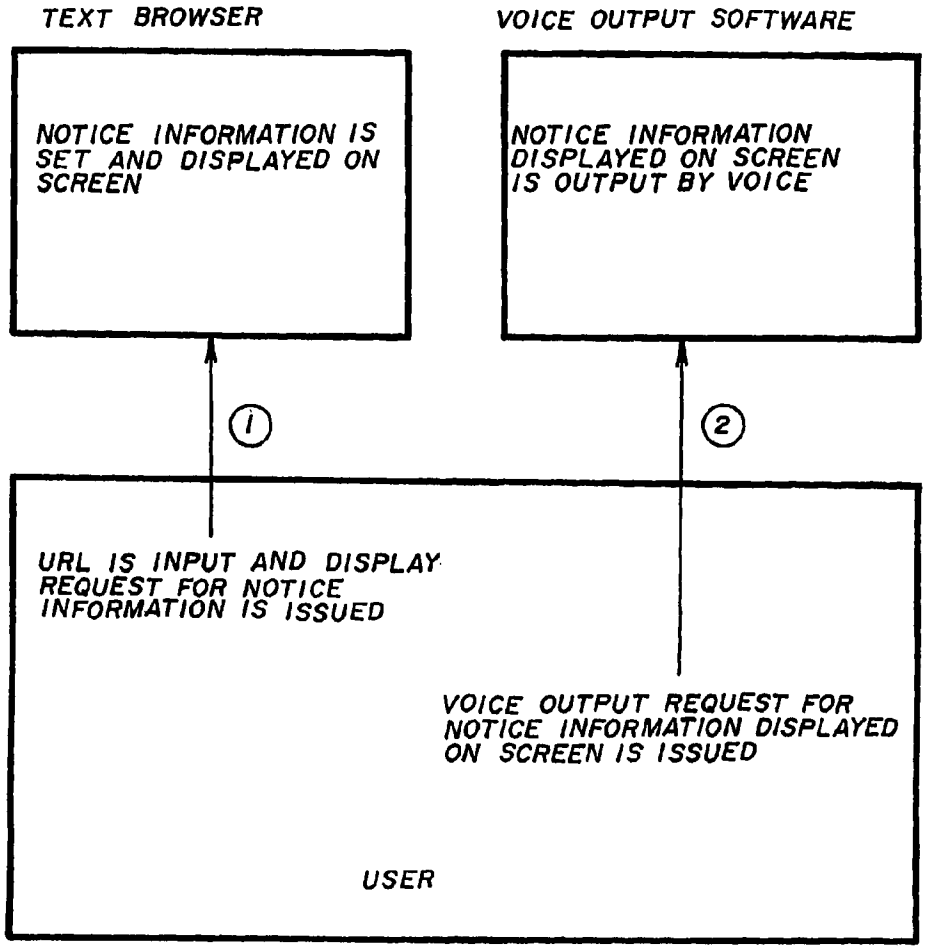
FIG. 1 is a block diagram illustrating a prior art information processing system.
Figure 2:
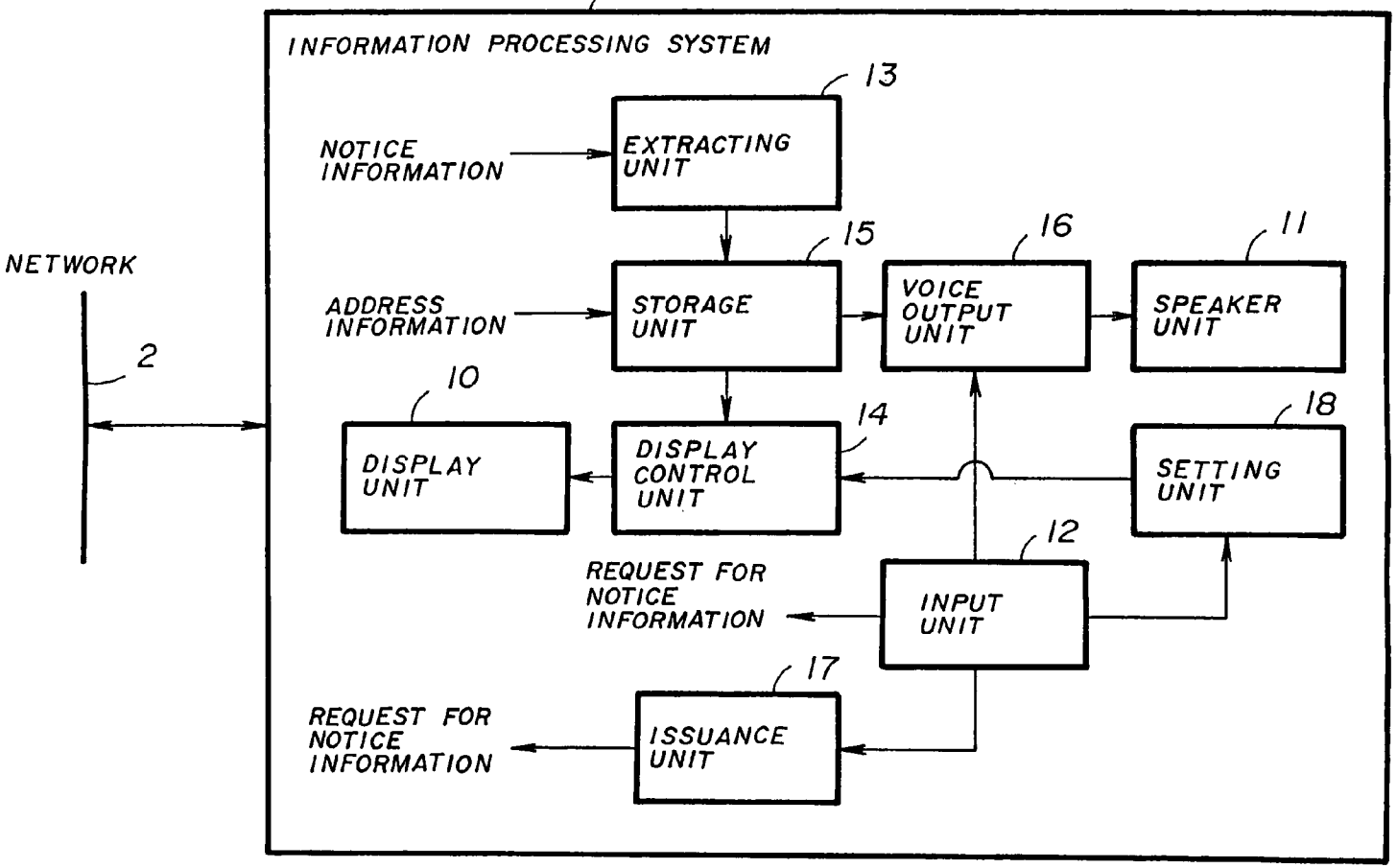
FIG. 2 is a block diagram illustrating a principle of an information processing system according to the present invention.

Referring to FIG. 2, the information processing system 1 receives and displays notice information having a predetermined format which is transmitted via a network 2. The information processing system 1 has a display unit 10, a speaker unit 11, an input unit 12, an extracting unit 13, a display control unit 14, a storage unit 15, a voice output unit 16, an issuance unit 17 and a setting unit 18. The display unit 10 is formed, for example, of a liquid crystal display panel. The speaker unit 11 has a loudspeaker. The input unit 12 has a keyboard and a mouse.

The extracting unit 13 analyzes the notice information. Based on the analyzing result, the extracting unit 13 extracts, from the notice information, character symbol information except for the format information, character symbol information having linked address information and character symbol information which is an identifier of information (e.g., image data) having linked address information except for character symbol information included in the notice information.

The display control unit 14 causes the display unit 10 to display the notice information, a list of character symbol information regarding information having the linked address information extracted by the extracting unit 13 and a list of address information (represented by characters and/or symbols) specified in accordance with a supply request for the notice information.

The storage unit 15 stores information which should be displayed on the display unit 10 under a control of the display control unit 14.

The voice output unit 16 converts the character symbol information except for the format information included in the notice information into voice signals and outputs the voice signals to the speaker unit 11. Further, the voice output unit 16 converts the list of the character symbol information regarding the information having the linked address information included in the notice information and the list of the address information specified in accordance with the supply request for the notice information into voice signals and outputs the voice signals to the speaker unit 11.

When specific character symbol information is selected from the list of character symbol information regarding the information having the linked address information displayed by the display control unit 14, the issuance unit 17 specifies the linked address information provided in the selected character symbol information and issues a supply request for the notice information.

The setting unit 18 sets the size of character symbol information displayed on the display unit 10.

In the information processing system 1 having the constitution as described above, when notice information is received, the extracting unit 13 analyzes the received notice information and extracts character symbol information except for the format information from the received notice information based on the analyzing result.

The display control unit 14 which receives the analyzing result from the extracting unit 13 causes the display unit 10 to display the notice information formed of characters, symbols and images using the analyzing result. At this time, for convenience of weak eyesight persons, the character symbol information displayed on the display unit 10 may be enlarged based on the size set by the setting unit 18.

The voice output unit 16 which receives the character symbol information extracted by the extracting unit 13 converts the received character symbol information into voice signals. The voice signals are supplied from the voice output unit 16 to the speaker unit 11. As a result, when the notice information is received, the notice information is output by voice from the speaker unit 11.

According to the information processing system 1 as described above, when notice information is transmitted via the network 2, the notice information is displayed on the screen of the display unit 10 and character symbol information included in the notice information is automatically output by voice along with the display of the notice information. Thus, users can hear contents of the notice information displayed on the screen of the display unit 10 without operations.

When a voice output request for the notice information displayed by the display control unit 14 is issued, the voice output unit 16 may cause the speaker unit 11 to output the notice information by voice. In addition, when a position in the notice information (displayed on the screen of the display unit 10) is specified and a voice output request for the notice information is issued, the voice output unit may output a part of the notice information which is displayed at the specified position.

Thus, the user can hear the contents of the notice information displayed on the screen of the display unit 10 at any time and the contents of a desired part of the notice information.

The extracting unit 13 may extract character symbol information provided with linked address information included in the notice information. When the notice information includes information having linked address information except for character symbol information, the extracting unit 13 may extract character symbol information which is an identifier of the information. In response to the extraction of information in the extracting unit 13, the control unit 14 causes the display unit 10 to display the list of the character symbol information. At this time, for the convenience of people having weak eyesight, the display control unit 14 may enlarge the list of character symbol information displayed on the screen of the display unit at the size set by the setting unit 18.

When a voice output request for the list of character symbol information displayed by the display control unit 14 is issued, the voice output unit 16 may output, by voice, the character symbol information included in the list. When a position is specified in the list of the character symbol information displayed on the screen by the display control unit 14 and a voice output request is issued, the voice output unit 16 may output, by voice, character symbol information displayed at the specified position.

Thus, the user can hear the information having the linked address information included in the received notice information.

In addition, when specific character symbol information is selected from the list of character symbol information displayed on the screen by the display control unit 14, the issuance unit 17 specifies linked address information provided in the selected character symbol information and issues a supply request for the notice information.

Thus, the user can access information linked to the received notice information without depending on eyesight.

In addition, the display control unit 14 may cause the display unit 10 to display a list of address information specified using the input unit 12 and address information specified when the issuance unit 17 issues a supply request for the notice information. At this time, for convenience of weak eyesight persons, the list of address information may be enlarged on the screen of the display unit 10 at the size set by the setting unit 18.

When a voice output request for the list of address information displayed by the display control unit 18 is issued, the voice output unit 16 outputs the list of address information by voice. When a position in the list of address information is specified and a voice output request is issued, the voice output unit 16 outputs address information displayed at the specified position by voice.

Thus, the user can recognize contents of input operations and operations to be input next without depending on eyesight.

According to the information processing system 1, the user can access notice information transmitted via the network 2 without depending on eyesight. Thus, people with an eyesight disorder using the information processing system 1 according to the present invention can easily access notice information transmitted via the network 2.

A description will now be given of an embodiment of the present invention.

Figure 3:
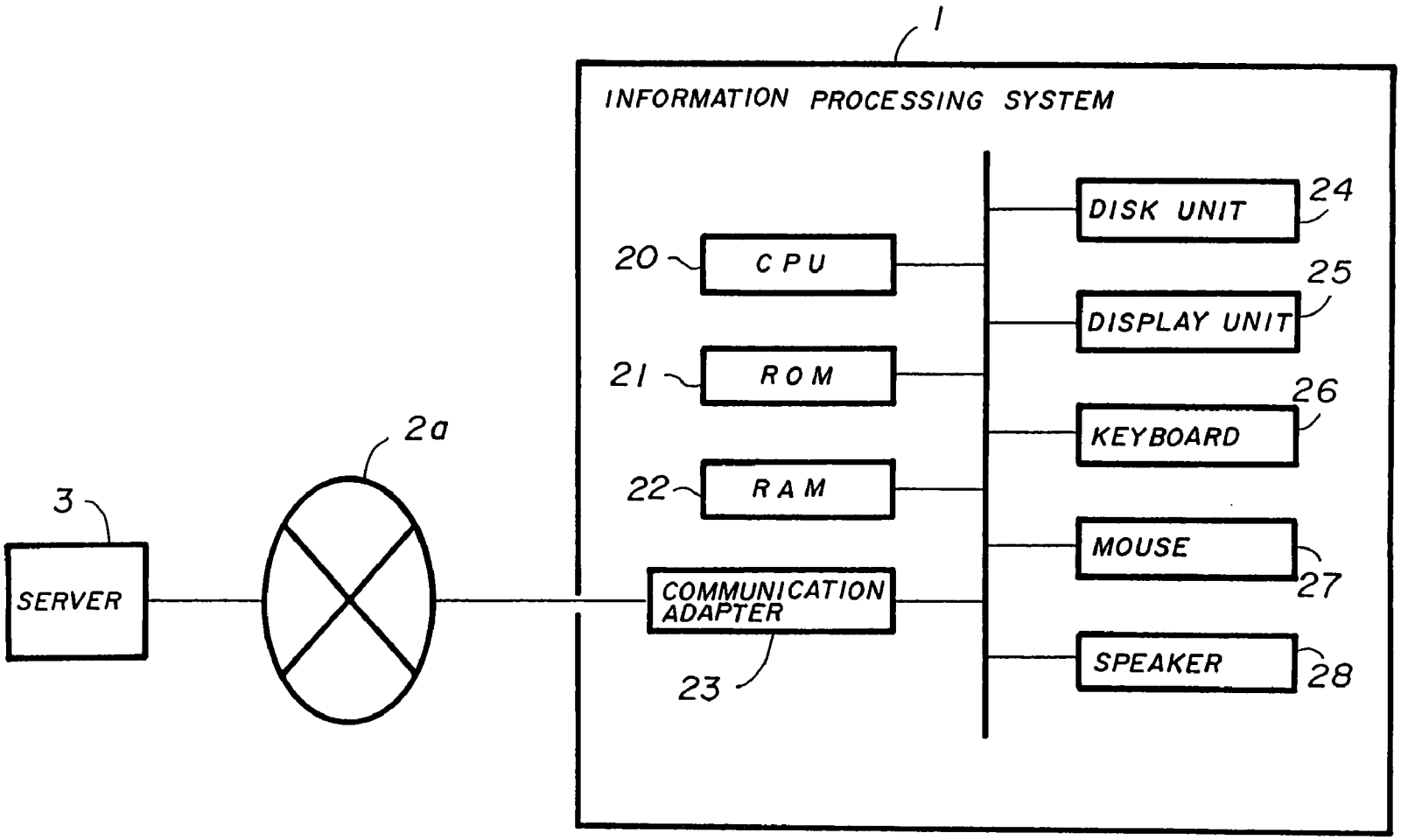
FIG. 3 is a block diagram illustrating hardware of a computer system to which the information processing system according to an embodiment of the present invention is applied.

Hardware of the information processing system 1 is formed as shown in FIG. 3. Referring to FIG. 3, the information processing system 1 is connected to a server 3 via an internet 2*a*. The information processing system 1 receives and displays HTML documents (WWW pages) supplied from the server 3. The information processing system 1 has a CPU 20, a ROM 21, a RAM 22, a communication adapter 23, a disk unit 24, a display unit 25, a keyboard 26, a mouse 27 and a speaker 28.

Figure 4:
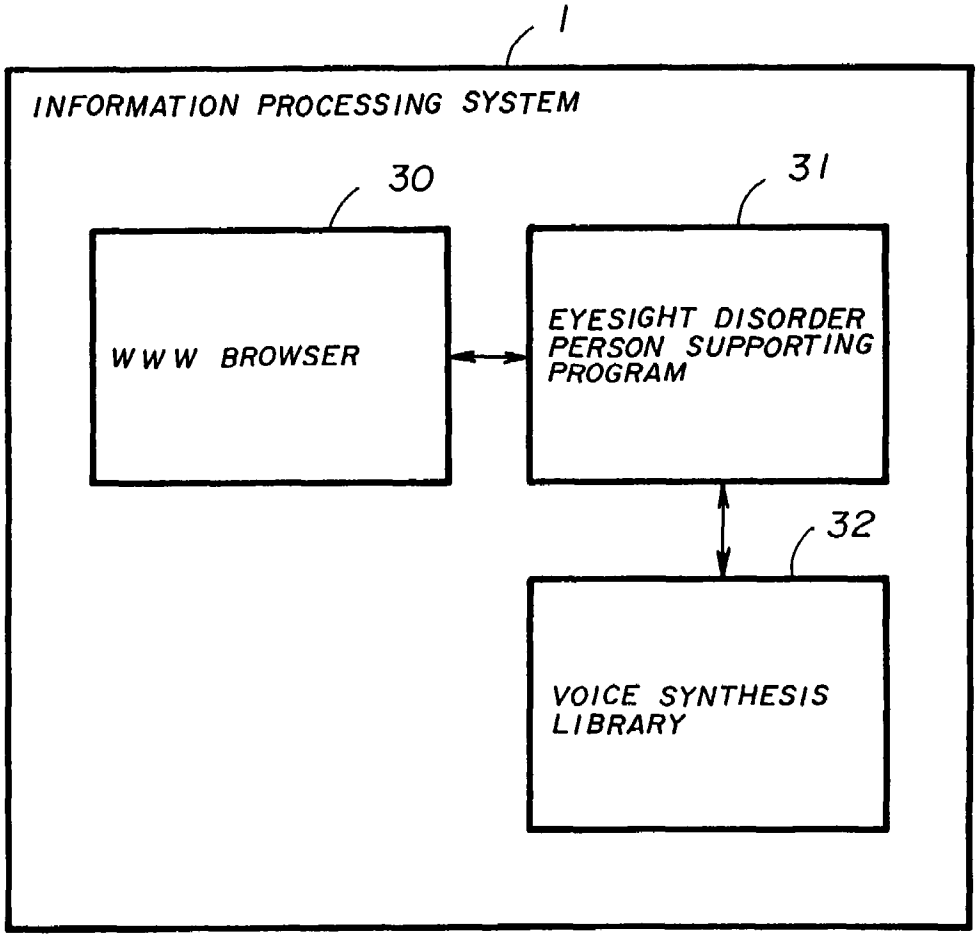
FIG. 4 is a block diagram illustrating programs used in the computer system.

The information processing system 1 has software, as shown in FIG. 4, of a WWW browser 30, a support program 31 for people with an eyesight disorder and a voice synthesis library 32. The WWW browser 30 is prepared to access the HTML documents supplied from the server 3. The supporting program 31 is prepared to realize the present invention. The supporting program 31 is used as subroutines which supply codes. When a code or a string of codes is supplied from the supporting program 31, the voice synthesis library 32 generates voice signals corresponding to the code or the string of codes and supplies the voice signals to the speaker 28. As a result, contents represented by the code or the string of codes are output from the speaker 28 by voice.

Each of the HTML documents supplied from the server includes characters, symbols and image data as a body and format information and link information to other pages. Such format information and link information is sandwiched by symbols "<" and ">". Further, the link information is represented by a tag such as "<a herf . . . >".

An example of the HTML document is shown in FIG. 5. In the HTML document shown in FIG. 5, a character string of "ALL-AROUND" is linked to an HTML document identified by a URL of "front.html". A character string of "POLITICS" is linked to an HTML document identified by a URL of "polit.html". A character string of "ECONOMY" is linked to an HTML document identified by a URL of "econm.html". A character string of "SPORT" is linked to an HTML document identified by a URL of "sport.html". Image data having a file name of "index030903.gif" is linked to an HTML document identified by a URL of "sport.html".

Hereinafter, information (e.g., "ALL-AROUND") linked to another page is referred to as a link item. In the HTML document shown in FIG. 5, display positions and image data are omitted for convenience.

FIGS. 6 through 17 show examples of flowcharts of the supporting program 31 for people with an eyesight disorder.

Figure 6:
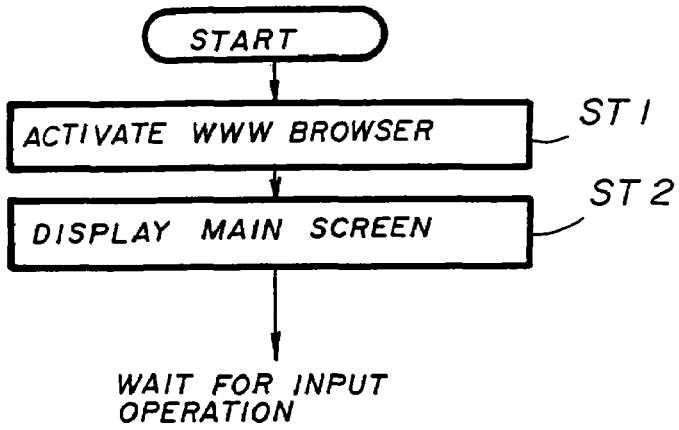
FIGS. 6 through 17 are flowcharts illustrating supporting programs for people with an eyesight disorder.

When a start request is supplied to the supporting program 31, initially as shown in FIG. 6, step 1 activates the WWW browser 30, and step 2 then opens a main window. After this, the supporting program 31 waits for an input operation.

Figure 18:
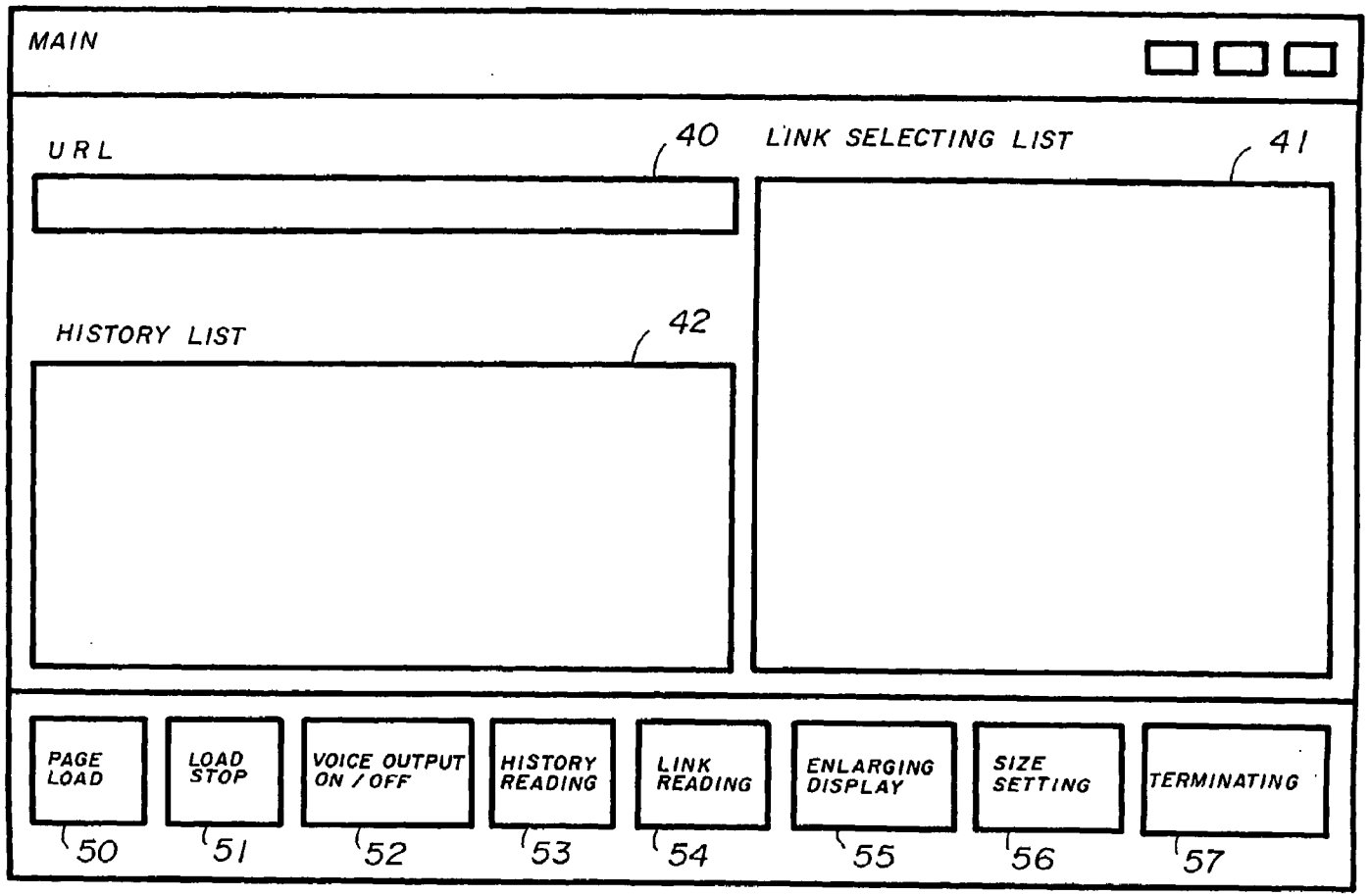
FIGS. 18 through 24 are diagrams illustrating examples of display screens.

FIG. 18 shows an example of the main window.

Referring to FIG. 18, the main window has a URL input area 40, a link selecting list 41, a history list 42, a page load button 50, a load stop button 51, a voice output ON/OFF button 52, a history reading button 53, a link reading button 54, an enlarging display button 55, a size setting button 56 and a terminating button 57.

The URL input area 40 is used to input URLs. Link items provided in the HTML documents transmitted from the server 3 are displayed in the link selecting list 41. History information of the URL issued by the server 3 is displayed in the history list 42. The page load button 50 is used to issue a load request for the HTML document. The load stop button 51 is used to provide an instruction to stop loading the HTML document. The voice ON/OFF button 52 is used to set either a voice output mode or a voice non-output mode. The history reading button 53 is used to provide instruction to read out the URLs displayed on the history list 42. The link reading button 54 is used to provide instruction to read out link items displayed in the link selecting list 41. The enlarging display button 55 is used to provide instruction to display an enlarged screen. The size setting button 56 is used for instruction to set the size of characters and symbols displayed on the display screen. The terminating button 57 is used to provide instruction to terminate processes.

Figure 7:
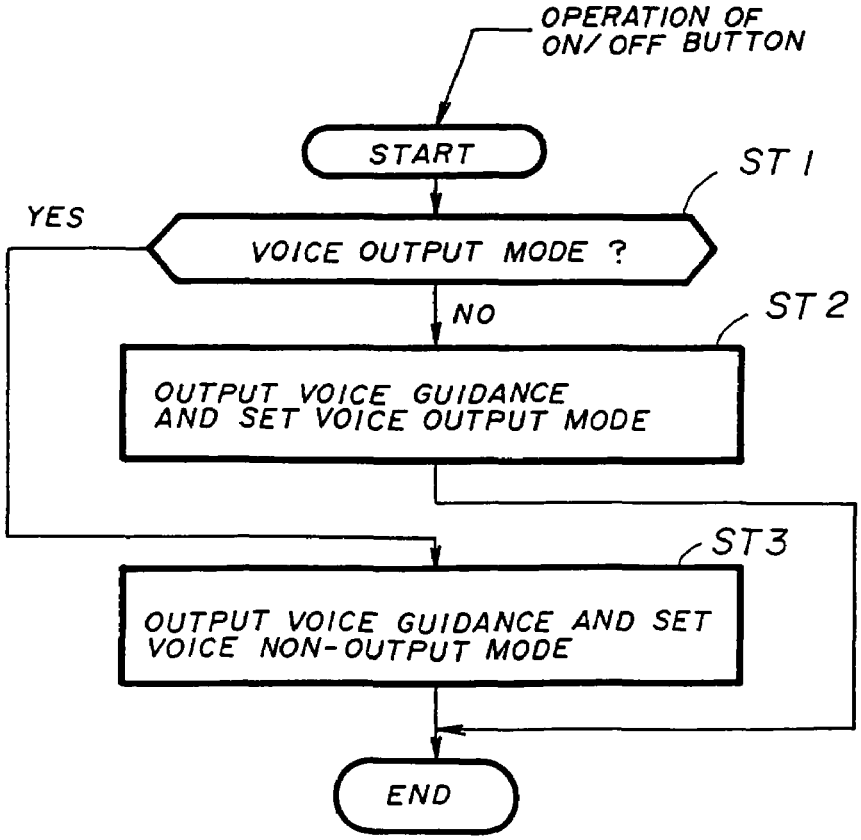

When a user operates the voice output ON/OFF button 52 on the main screen, the supporting program 31 is executed in accordance with a procedure shown in FIG. 7. The instruction issued by the operation of the voice output ON/OFF button 52 can also be issued by operations of the keyboard 26. Referring to FIG. 7, step 1 determines whether the voice output mode or the voice non-output mode has been set. In an initial state, for example, the voice non-output mode has been set. When it is determined that the voice non-output mode has been set, the procedure proceeds to step 2. In step 2, a voice guidance "VOICE OUTPUT MODE IS SET" is output using the voice synthesis library 32 and the voice output mode is set so that information is thereafter output by voice.

The voice guidance "VOICE OUTPUT MODE IS SET" is generated as follows. Code information representing a character string of "VOICE OUTPUT MODE IS SET" and a voice output instruction are supplied to the voice synthesis library 32. In response to the voice output instruction, the voice synthesis library 32 generates voice signals of "VOICE OUTPUT MODE IS SET" in accordance with the received code information. The voice signals are supplied to the speaker 27 so that the voice guidance "VOICE OUTPUT MODE IS SET" is output by voice from the speaker 27.

On the other hand, it is determined, in step 1, that the voice output mode has not been set, the procedure proceeds to step 3. In step 3, a voice guidance "VOICE NON-OUTPUT MODE IS SET" is output using the voice synthesis library 32 and the voice non-output mode is set so that information is thereafter not output by voice.

As has been described above, when the user operates the voice output ON/OFF button 52 on the main screen, the supporting program 31 changes the mode from voice non-output mode, which has been set, to the voice output mode or from the voice output mode, which has been set, to the voice non-output mode.

Hereinafter, for convenience, it is assumed that the voice output mode is set.

Figure 8:
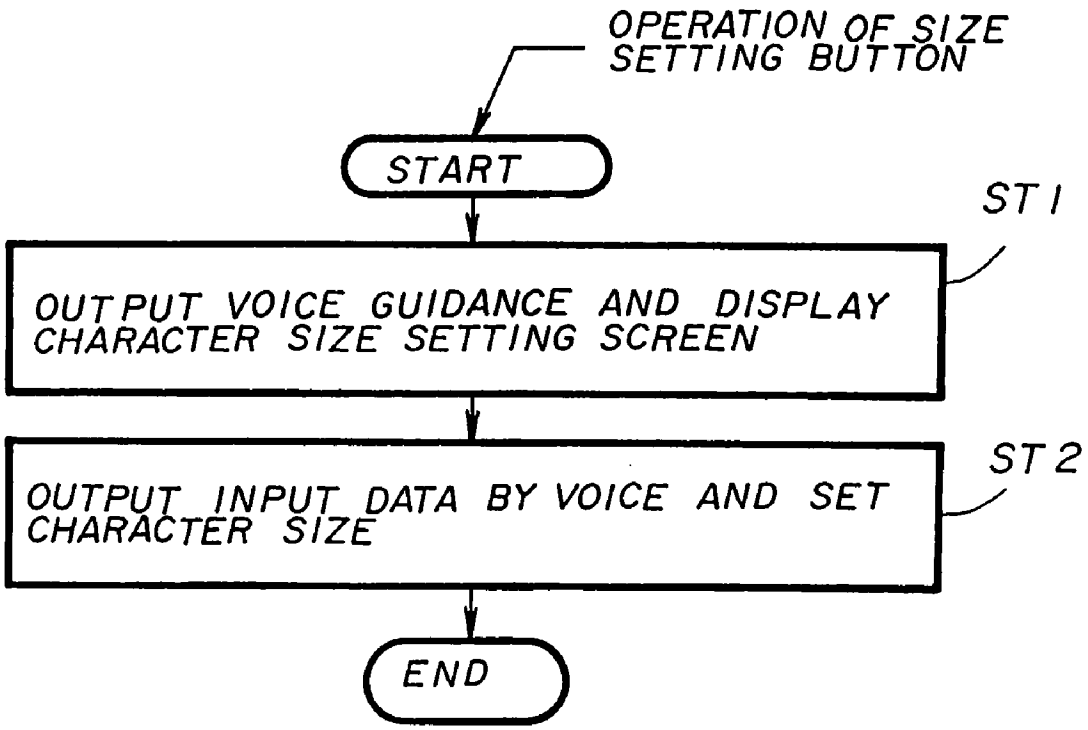
Figure 19:
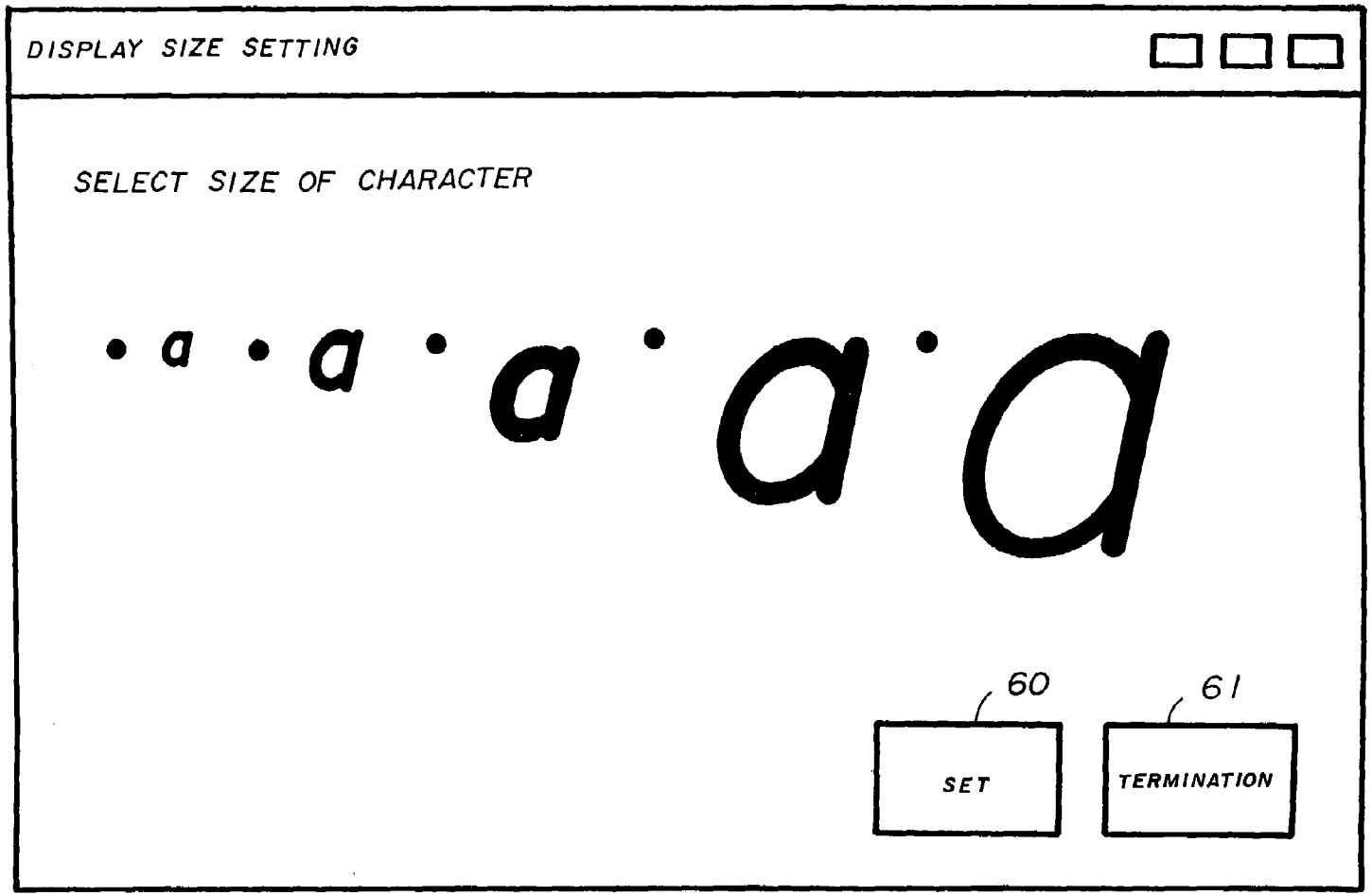

When the user operates the size setting button 56 on the main screen, the supporting program 31 is executed in accordance with a procedure shown in FIG. 8. The instruction issued by the operation of the size setting button 56 can be issued by operations of the keyboard 26. Referring to FIG. 8, in step 1, a voice guidance "ENLARGED DISPLAY IS SET" is output using the voice synthesis library 32 and a character size setting screen as shown in FIG. 19 is displayed. On the character size setting screen, five characters of different size, a setting button 60 and a terminating button 61 are displayed.

In step 2, due to operations of the keyboard 26 or the mouse 27, a cursor is moved to and positioned at one of the characters displayed on the character size setting screen. At this time, code information corresponding to the size of the character pointed by the cursor is supplied to the voice synthesis library 32. As a result, for example, a voice guidance "SIZE NUMBER IS THREE" is output by voice. When the setting button 60 is operated (the same instruction can be issued by the operation of the keyboard 26) in this state, a message "CHARACTER SIZE IS SET" is output by voice using the voice synthesis library 32. The size of the character pointed by the cursor is set as the size used in the display process thereafter. When the terminating button 61 is operated (the same instruction can be issued by the operation of the keyboard 26), a voice guidance "SCREEN RETURNS TO MAIN SCREEN" is output by voice using the voice synthesis library 32. The screen returns to the main screen. The size of characters displayed on the screen can be set by inputting a number from the keyboard 26.

As has been described above, when the user operates the setting button 56 on the main screen, the supporting program 31 interacts with the user using the character size setting screen as shown in FIG. 19 and sets the size of enlarged characters and symbols which should be displayed.

After setting the mode (the voice output mode or the voice non-output mode) and the character size of the enlarged display, the user operates the tab key of the keyboard so that the cursor is moved to the URL input area 40 on the main screen in order to obtain an HTML document supplied from the server 3.

Figure 9:
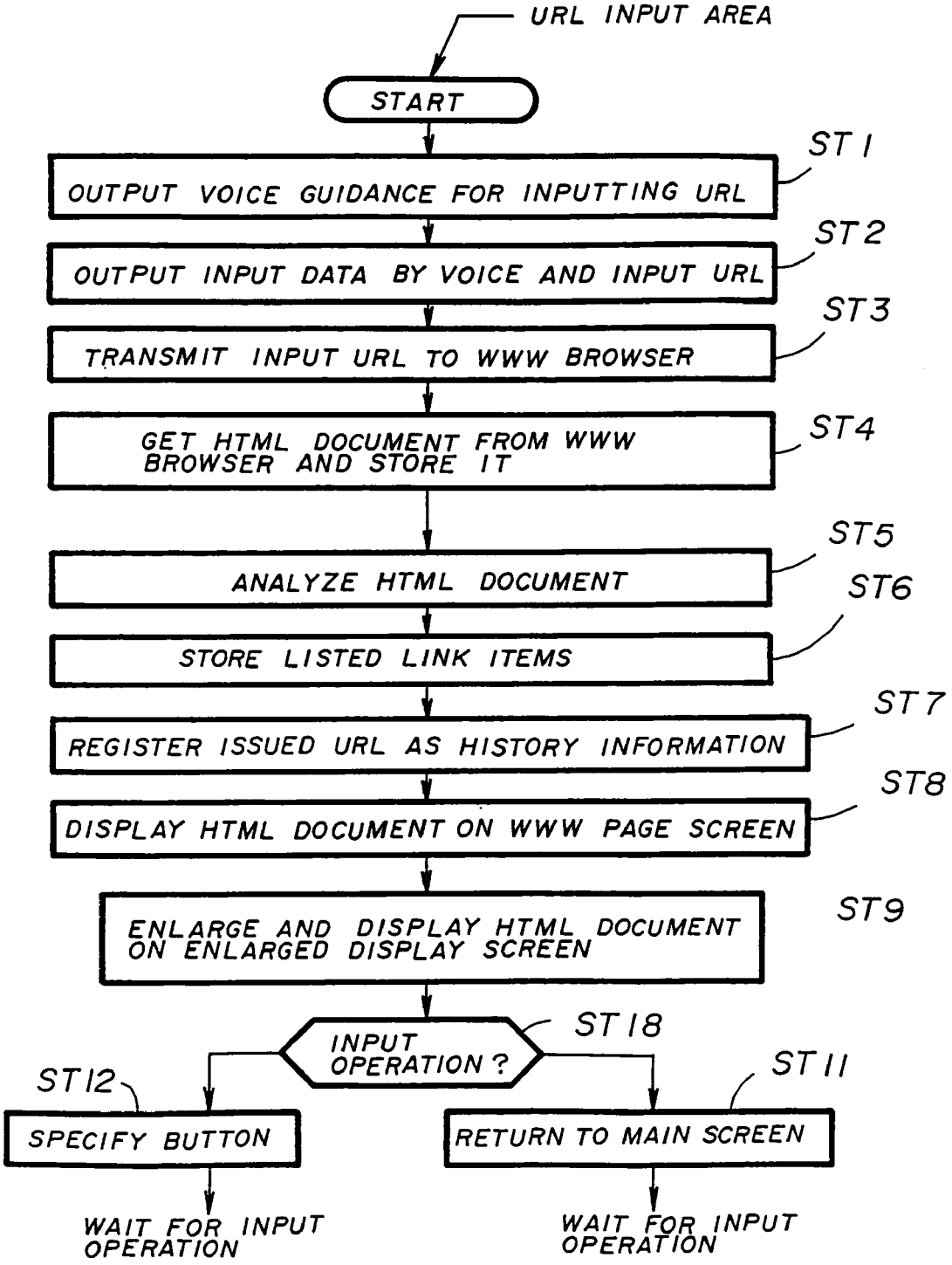

After this, when the cursor is brought into the URL input area 40 on the main screen by the user, the supporting program 31 is executed in accordance with a procedure as shown in FIG. 9. Referring to FIG. 9, in step 1, a voice guidance "PLEASE INPUT URL" is output by voice using the voice synthesis library 32.

Figure 20:
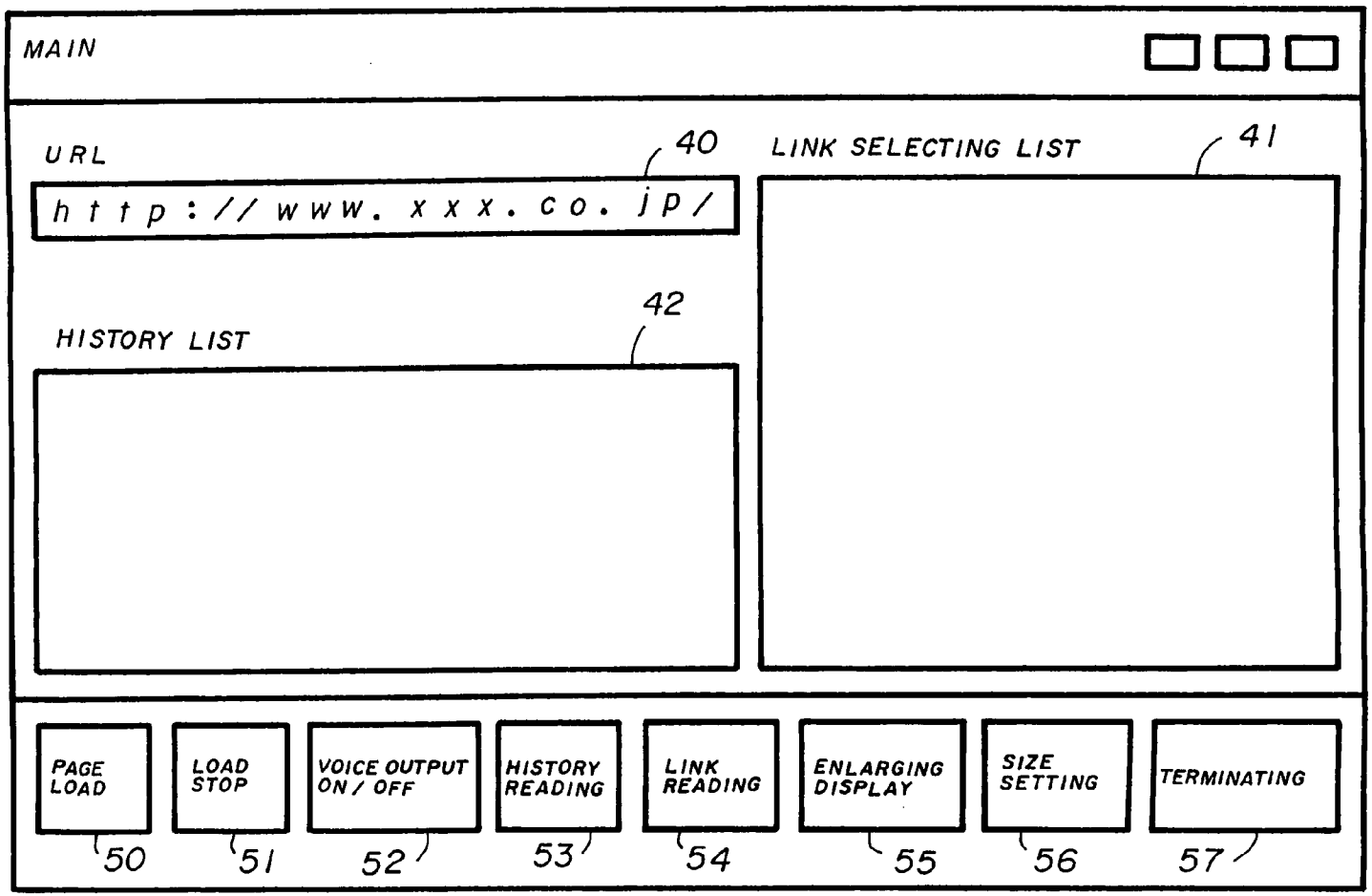

In response to the voice guidance, the user inputs a URL in the URL input area 41 using the keyboard 26. Thus, in step 2, characters and symbols corresponding to operated keys are displayed in the URL input area 41 at the size set using the character size setting screen as shown in FIG. 20. Characters and symbols corresponding to the operated keys are successively read out one by one, such as "A" [ei], "B" [bi:] and "C" [si:] so that the characters and symbols are input. When the page load button 50 is operated (the keyboard 26 (e.g., an enter key) operated to issue the same instruction), input characters are read out using the voice synthesis library 32, so that the user confirms the input URL.

In step 3, when the page load button 50 (the enter key of the keyboard 26) is operated again, a voice guidance "WWW PAGE IS LOADED" and the input URL is transmitted to the WWW browser 30.

When the WWW browser 30 receives the URL from the supporting program 31, the WWW browser 30 transmits the URL to the server 3 to receive an HTML document identified by the URL.

The supporting program 31, in step 4, then receives the HTML document from the WWW browser 30. The HTML document is stored in the disk unit 34. In step 5, the received HTML document is analyzed, so that characters and symbols other than format information are extracted from the HTML document and image data is extracted and link items are further extracted from the extracted characters, symbols and image data.

As has been described above, in the HTML document, the link item is represented using the tag "<a href . . . >". Thus, characters and symbols having the tag are extracted, so that the link items can be extracted. For example, in a case where the HTML document as shown in FIG. 5 is received, "ALL-AROUND", "POLITICS", "ECONOMY", "SPORT" and "index030903.gif" are extracted as the link items.

In a case where a character string "alt", which represents contents of image data is assigned to the image data, it is preferable that a character string, such as "SOCCER", registered as the "alt" is extracted as the link item substituted for the file name such as "index030903.gif".

In step 6, the extracted link items are listed. The listed link items are then stored in a memory area, corresponding to the link selecting list 41, of the disk unit 34. In step 7, the issued URL is a memory area, corresponding to the history list 42, of the disk unit 34.

Figure 21:
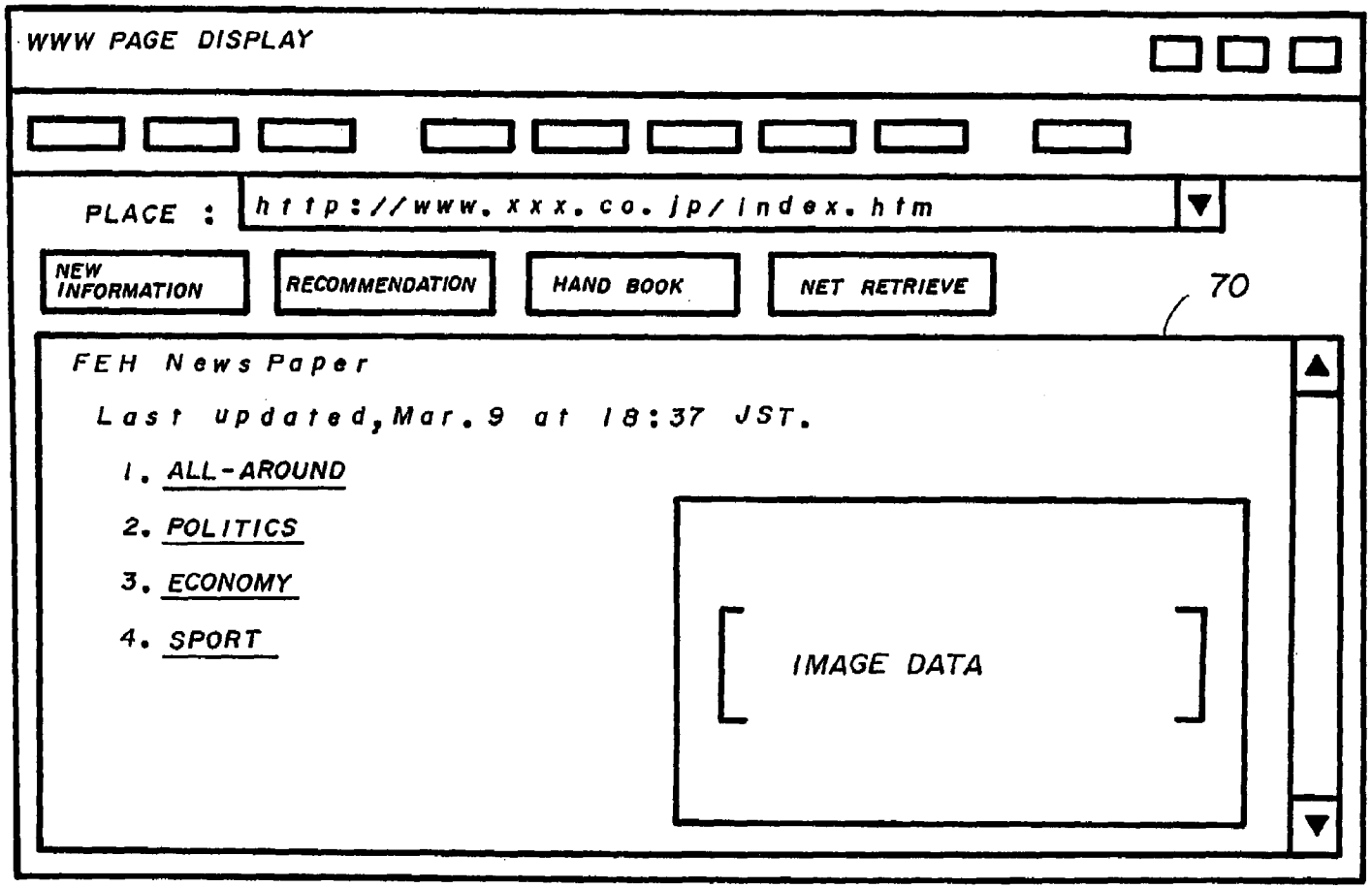

In step 8, the received HTML document is displayed on a WWW page display screen (a display area 70) as shown in FIG. 21 based on the analyzing result obtained in step 5. The WWW page is activated when the voice non-output mode is set and is substantially identical to a display screen of the HTML document in the conventional case.

In the conventional case, the displaying process in the screen for the WWW page is entrusted to the WWW browser. However, in the present invention, the display of the received HTML document and the output thereof by voice are automatically linked, and the supporting program 31 is executed to display enlarged characters and symbols which are not included in the WWW browser 30.

Figure 22:
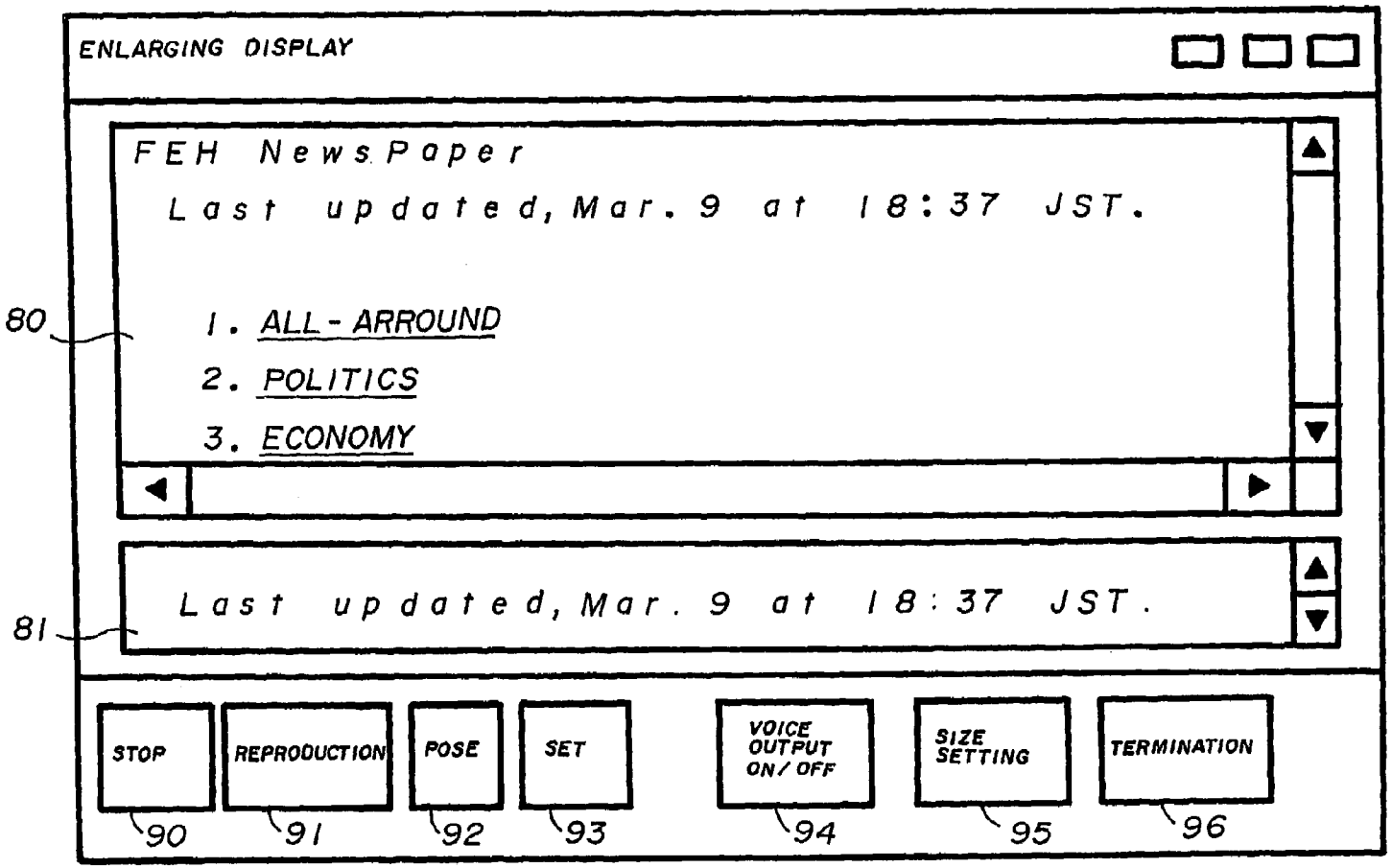

When the WWW page display screen is displayed in step 8 and the voice output mode is set, the process proceeds to step 9. In step 9, an enlarged display screen as shown in FIG. 22 is opened. The received HTML document is enlarged at the size set using the character size setting screen and displayed. Code information of characters and symbols other than the format information included in the HTML document is supplied to the voice synthesis library 32, so that the HTML document is output by voice. As to image data included in the HTML document, an image represented by the image data can be enlarged and displayed at the character size and not enlarged and displayed.

The enlarged display screen has, as shown in FIG. 22, a first display area 80, a second display area 81, a stop button 90, a reproduction button 91, a pose button 92, a setting button 93, a voice output ON/OFF button 94, a size setting button 95 and a terminating button 96. The first display area 80 is used to display HTML documents. The second display area 81 is used to display a line of the HTML document which is output by voice. The stop button 90 is used to stop outputting information by voice. The reproduction button 91 is used to output a portion pointed by the cursor by voice. The pose button 92 is used to temporarily stop outputting by voice. The setting button 93 is used to display a voice setting screen. The voice output ON/OFF button 94 has the same function as the voice output ON/OFF button 52 included in the main screen. The size setting button 95 has the same function of the size setting button 56 included in the main screen. The terminating button 96 is used to terminate the process.

Returning to FIG. 9, in step 10, it is determined what input operation has been performed. When it is determined that a specific key (e.g., a F12 key) has been operated, the procedure proceeds to step 11. In step 11, the screen returns to the main screen and the system waits for an input operation. When it is determined that a key provided in the enlarged display screen has been operated, the procedure proceeds to step 12. In step 12, after a process specified by the operated key is completed, the system waits for an input operation.

As has been described above, when the user inputs a URL in a state where the main screen is displayed, the supporting program 31 uses the WWW browser 30 and gets a HTML document identified by the input URL. Link items included in the HTML document are then extracted. The HTML document is enlarged and displayed on the enlarged display screen as shown in FIG. 22. Further, the HTML document is read out using the voice synthesis library 32.

Thus, the people with an eyesight disorder can hear the contents of the HTML document identified by the URL.

When the screen returns to the main screen from the enlarged display screen shown in FIG. 22 after the enlarged HTML document is displayed and the voice output of the HTML document is completed, the supporting program 31 reads out the link items from the disk unit 34 in which the link items are stored so as to be linked in step 6 shown in FIG. 9. The link items read out of the disk unit 34 are displayed in the link selecting list 41 of the main screen. The supporting program 31 further reads out the history information of URLs from the disk unit 34 in which the history information is stored in step 7 shown in FIG. 9. The history information of the URLs read out of the disk unit 34 is displayed in the history list 42 of the main screen.

Figure 23:
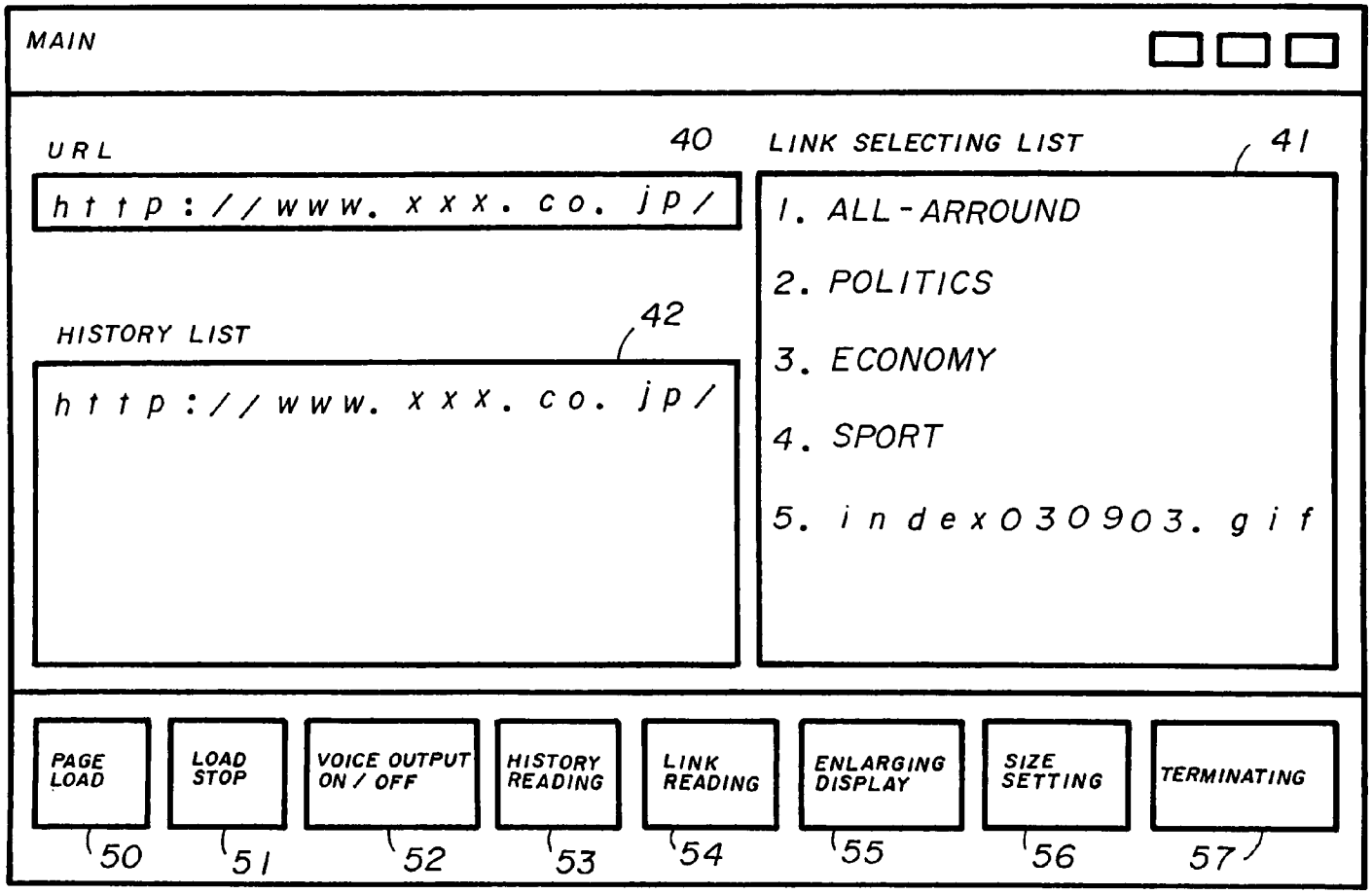

That is, after the screen returns to the main screen from the enlarged display screen, the eyesight disorder supporting program 31 causes the link items included in the HTML document to be displayed in the link selecting list 41 so as to be listed and the history information of the URLs which has been issued to be displayed in the history list 42, as shown in FIG. 23.

Figure 24:
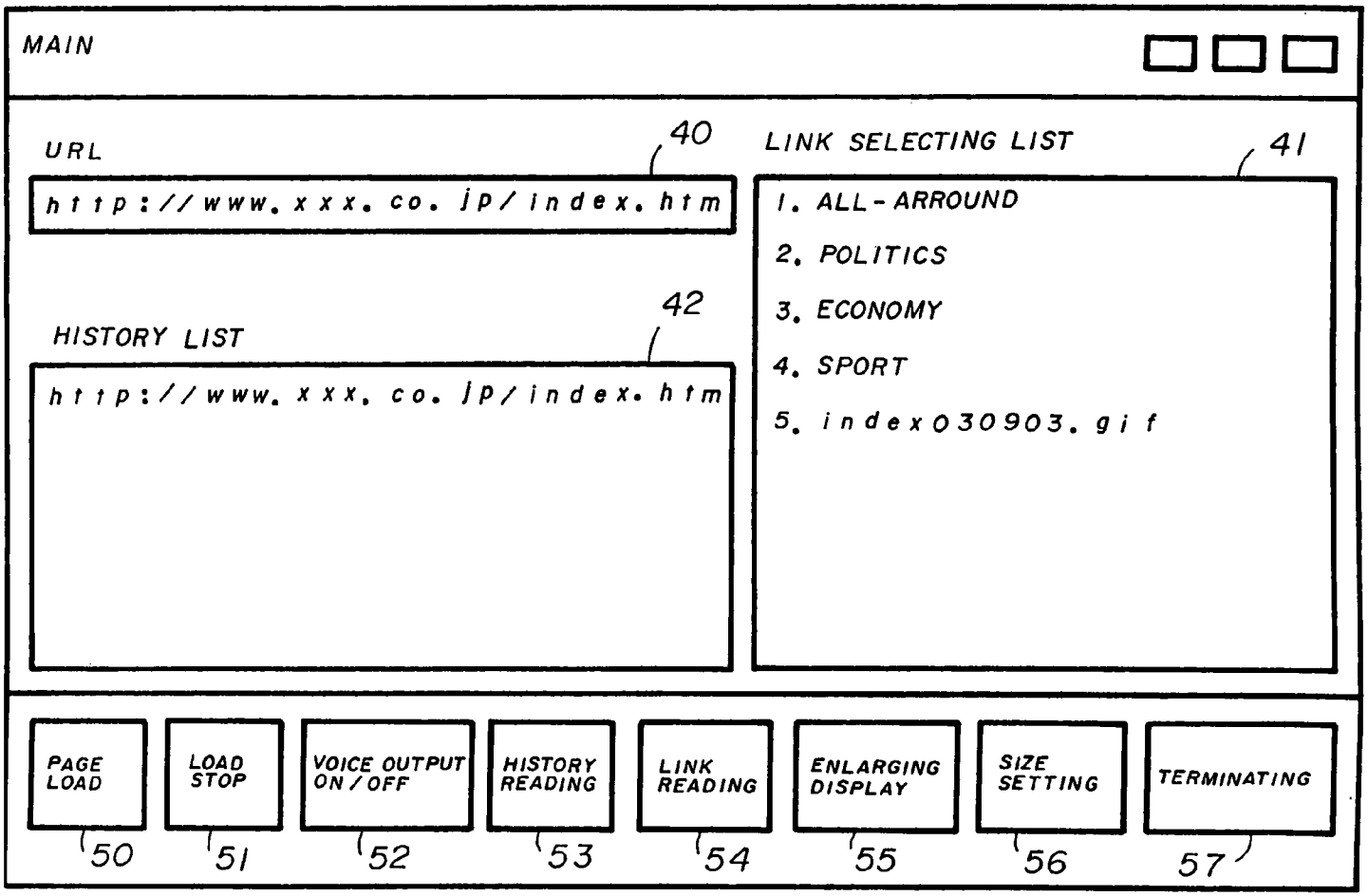

The link items displayed in the link selecting list 41 and the history information of the URLs displayed in the history list 42 are enlarged at a size set using the character size setting screen. Thus, it is easy for weak eyesight persons to recognize the link items and history information of the URLs displayed on the main screen in comparison with a case in which they are not enlarged on the main screen as shown in FIG. 24.

A description will now be given of processes executed when the link reading button 54, the history reading button 53 and the enlarging display button 55 on the main screen are operated.

Figure 10:
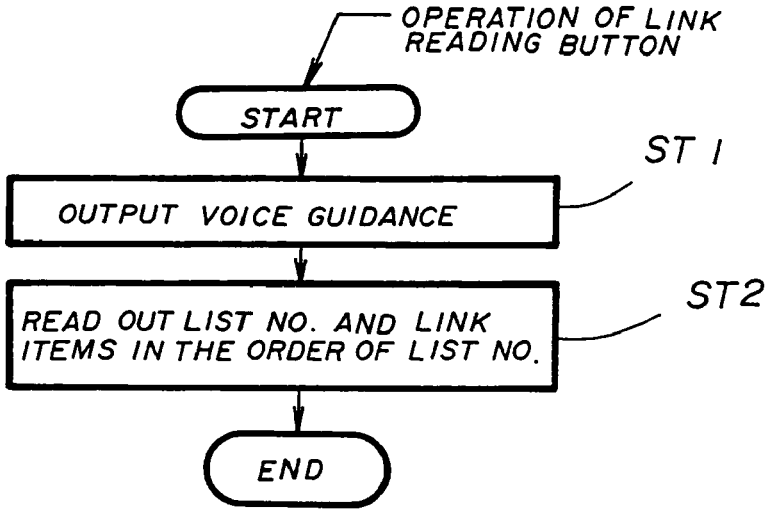

When the user operates the link reading button 54 on the main screen (the keyboard 26 can be operated to issue the same instruction), the supporting program 31 is executed in accordance with a procedure as shown in FIG. 10. Referring to FIG. 10, in step 1, a voice guidance "CONTENTS OF THE LINK LIST ARE READ OUT" is output by voice using the voice synthesis library 32.

In step 2, the link items displayed in the link selecting list 41 and list numbers of the respective link items are read out in the order of the list number using the voice synthesis library 32. In a case of the main screen shown in FIG. 23, the link items "NUMBER 1; ALL-AROUND", "NUMBER 2; POLITICS", "NUMBER 3; ECONOMY", "NUMBER 4; SPORT" and "NUMBER 5; index030903.gif" are output by voice.

Figure 11:
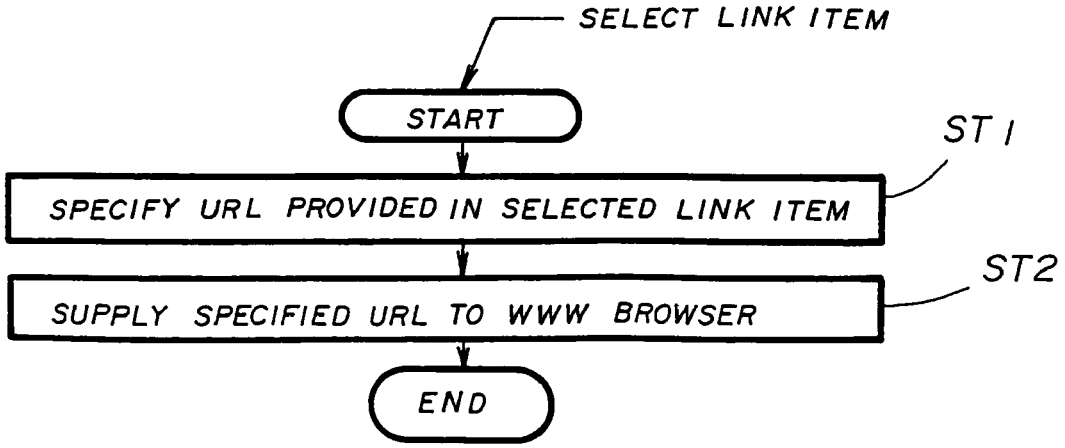

The user who has an eyesight disorder hears the link items output by voice. The user inputs a list number using keys of the keyboard 26. In response to specifying the list number, the supporting program 31 is executed in accordance with a procedure as shown in FIG. 11. Referring to FIG. 11, in step 1, a URL provided in the link item identified by the link number selected by the user is specified with reference to the analyzing result of the HTML document.

In step 2, the specified URL is supplied to the WWW browser 30 so that a HTML document directed by the link item is obtained.

Due to the processes shown in FIGS. 10 and 11, the people with an eyesight disorder can hear the link item provided in the received HTML document and recognize a HTML document directed by the link item without depending on eyesight.

Figure 12:
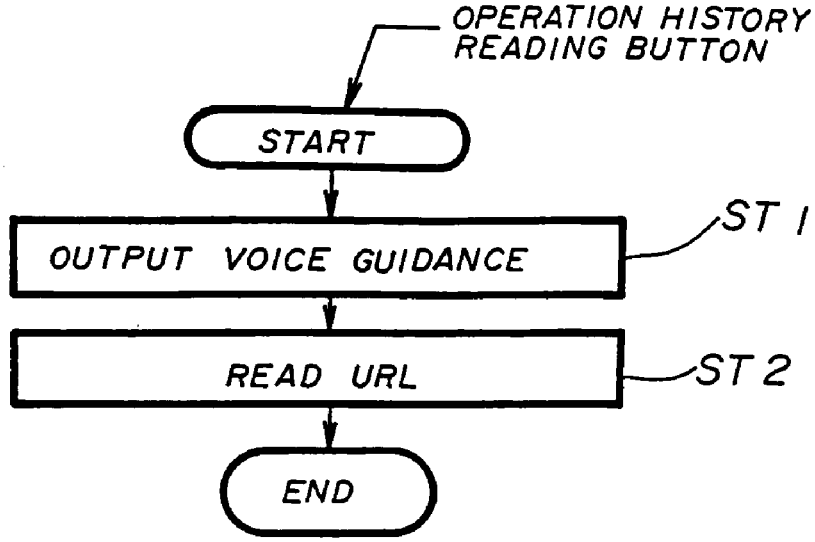

When the user operates the history reading button 53 on the main screen (the same instruction can be issued by the operation of the keyboard 26), the supporting program 31 is executed in accordance with a procedure as shown in FIG. 12. Referring to FIG. 12, in step 1, a voice guidance "CONTENTS OF THE HISTORY LIST ARE READ OUT" is output by voice using the voice synthesis library 32.

In step 2, the history information of the URLs displayed in the history list 42 is successively read out using the voice synthesis library 32.

According to the process shown in FIG. 12, the people with an eyesight disorder can hear the history information of the URLs which have been issued.

On the main screen, the user can move the cursor to one of the link selecting list 41, the history list 42 and the URL input area 40 using the tab key of the keyboard 26. Further, the cursor can be moved upward and downward in each of the link selecting list 41 and the history list 42 using up-down keys of the keyboard 26.

Figure 13:
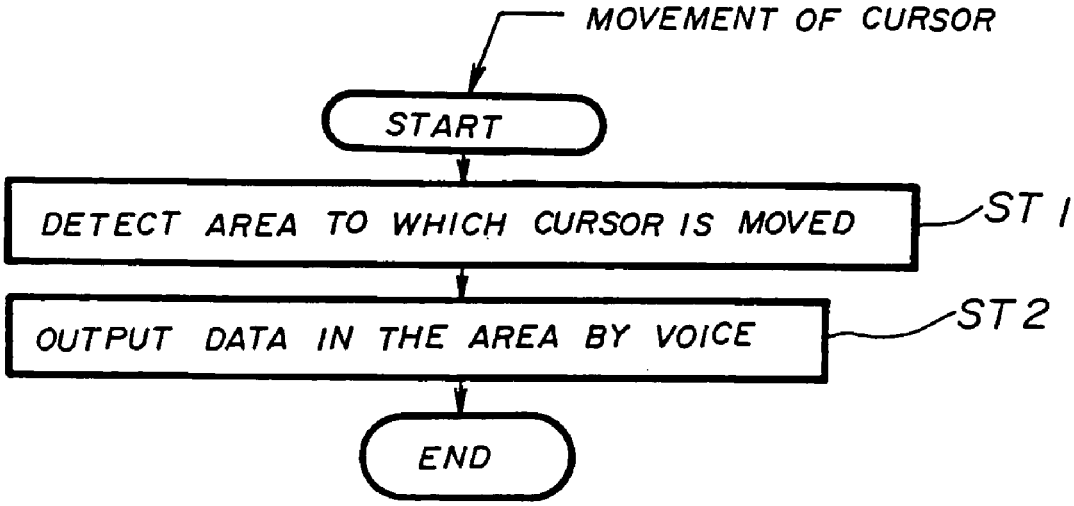

When the user operates the tab key of the keyboard 26 to move the cursor on the main screen, the supporting program 31 is executed in accordance with a procedure as shown in FIG. 13. Referring to FIG. 13, in step 1, an area to which the cursor is moved (the cursor is positioned at a head position of the area) is detected. The area is one of the link selecting list 41, the history list 42 and the URL input area 40. In step 2, data displayed in the detected area is output by voice using the voice synthesis library 32.

Figure 14:
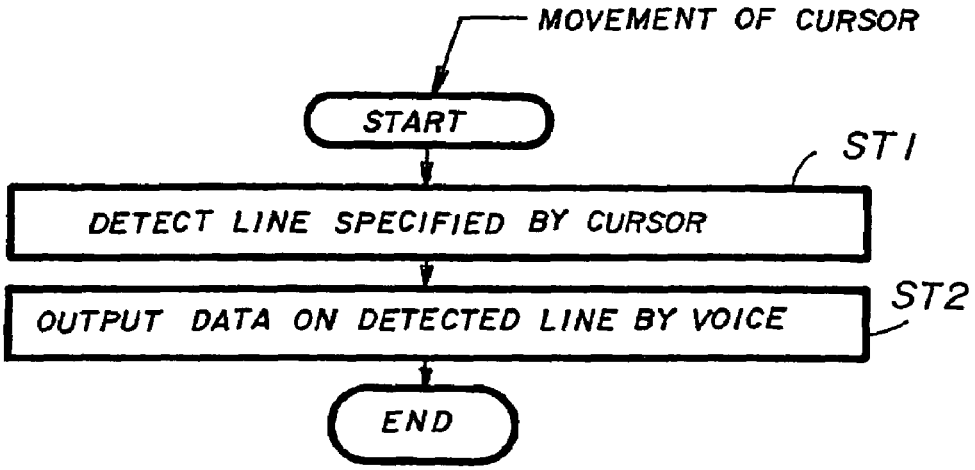

When the user operates the up-down keys to move the cursor upward and downward in one of the link selecting list 41 and the history list 42 on the main screen, the supporting program 31 is executed in accordance with a procedure as shown in FIG. 14. Referring to FIG. 14, in step 1, a line pointed by the cursor is detected. In step 2, data displayed in the line pointed by the cursor is output by voice using the voice synthesis library 32.

According to the processes shown in FIGS. 13 and 14, the people with an eyesight disorder can hear the link items displayed in the link selecting list 41 and the history information of the URLs displayed in the history list 42.

Figure 15:
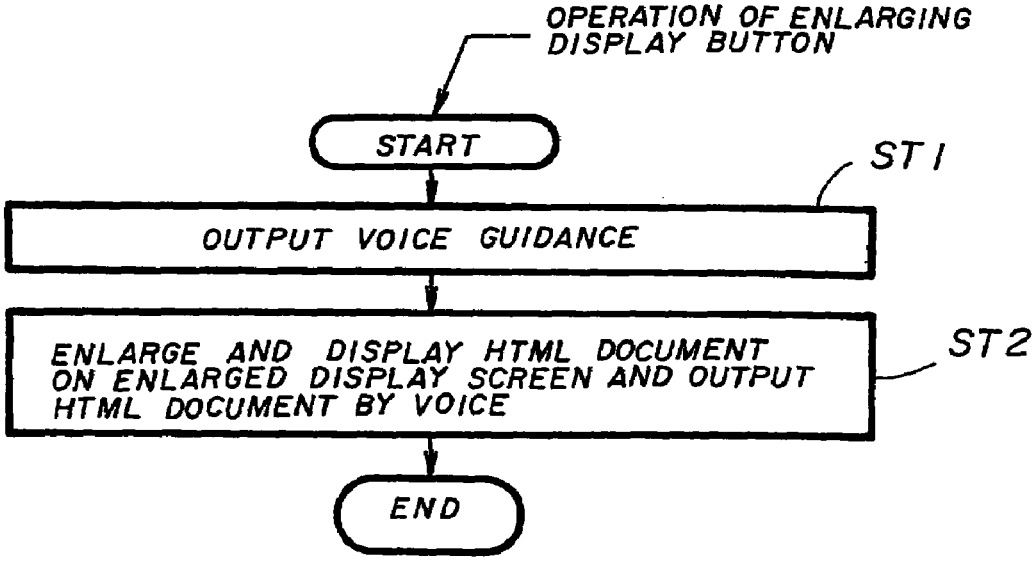

In addition, when the user operates the enlarging display button 55 on the main screen (the same instruction can be issued by the operation of the keyboard 26), the eyesight disorder supporting program 31 is executed in accordance with a procedure as shown in FIG. 15. Referring to FIG. 15, in step 1, a voice guidance "ENLARGED DISPLAY IS PERFORMED" is output by voice using the voice synthesis library 32.

In step 2, the enlarged display screen shown in FIG. 22 is displayed and the received HTML document is enlarged and displayed in the first display area 80. The code information of characters and symbols other than the format information provided in the HTML document is supplied to the voice synthesis library 32, so that the contents of the HTML document are output by voice.

According to the process shown in FIG. 15, the people with an eyesight disorder can hear the contents of the HTML at any time.

The enlarged display screen has the second display area 81 to use to display data for one line of the HTML document which is output by voice. In the second display area 81, as shown in FIG. 22, up-down key buttons are provided. When the up-down key buttons are operated using the mouse (the same instructions can be issued by the up-down keys of the keyboard 26), the line of data to be output by voice is changed.

Figure 16:
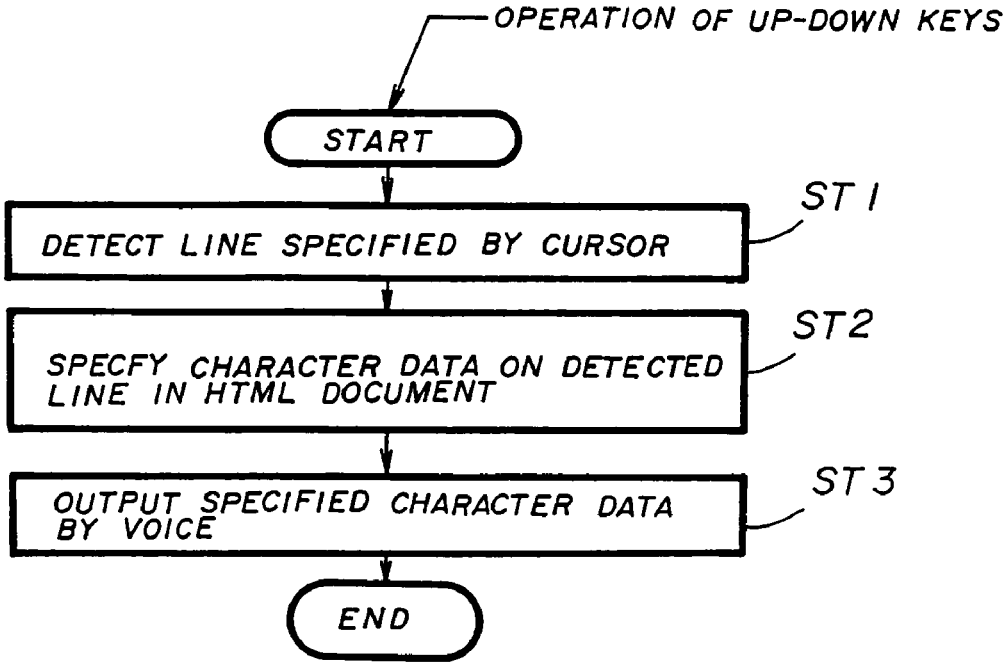

When the user operates the up-down key buttons in the second display area 81 on the enlarged display screen using the keyboard 26, the supporting program 31 is executed in accordance with a procedure as shown in FIG. 16. Referring to FIG. 16, in step 1, a line pointed by the cursor is detected. In step 2, a data part on the detected line is specified in the HTML document displayed in the first display area 80. In step 3, the specified data part of the HTML document is output by voice using the voice synthesis library 32.

The enlarged display screen has the reproduction button 91 used to output data pointed by the cursor by voice.

Figure 17:
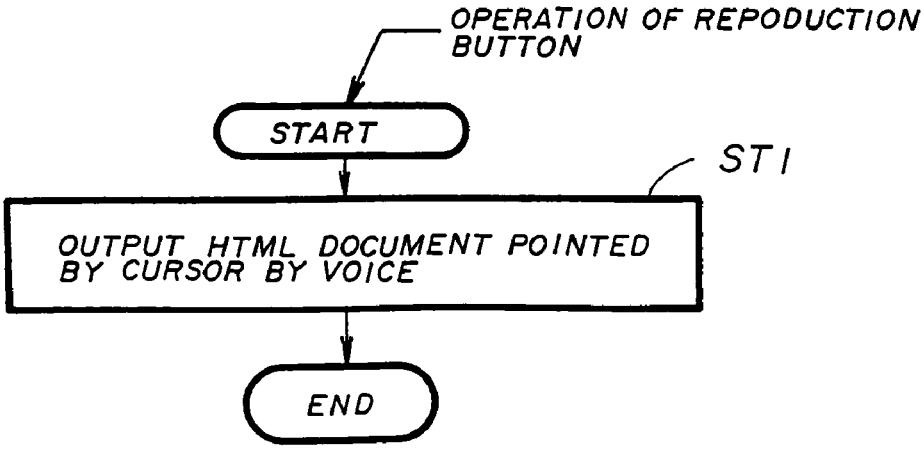

When the user operates the reproduction button 91 on the enlarged display screen (the same instruction can be issued by the operation of the keyboard 26), the supporting program 31 is executed in accordance with a procedure as shown in FIG. 17. That is, the contents of a data part of the HTML document displayed on the line are output by voice using the voice synthesis library 32.

According to the processes shown in FIGS. 16 and 17, the people with an eyesight disorder can freely hear the contents of the HTML documents displayed on the enlarged display screen.

A description will now be given of an operation based on the setting button 93 on the enlarged display screen shown in FIG. 22.

The setting button 93 is used to set parameters required for the voice output operation of the voice synthesis library 32. When the setting button 93 is operated, the supporting program 31 supplies to the voice synthesis library 32 an instruction to display a parameter setting screen used to set the parameters required for the voice output operation.

Figure 25:
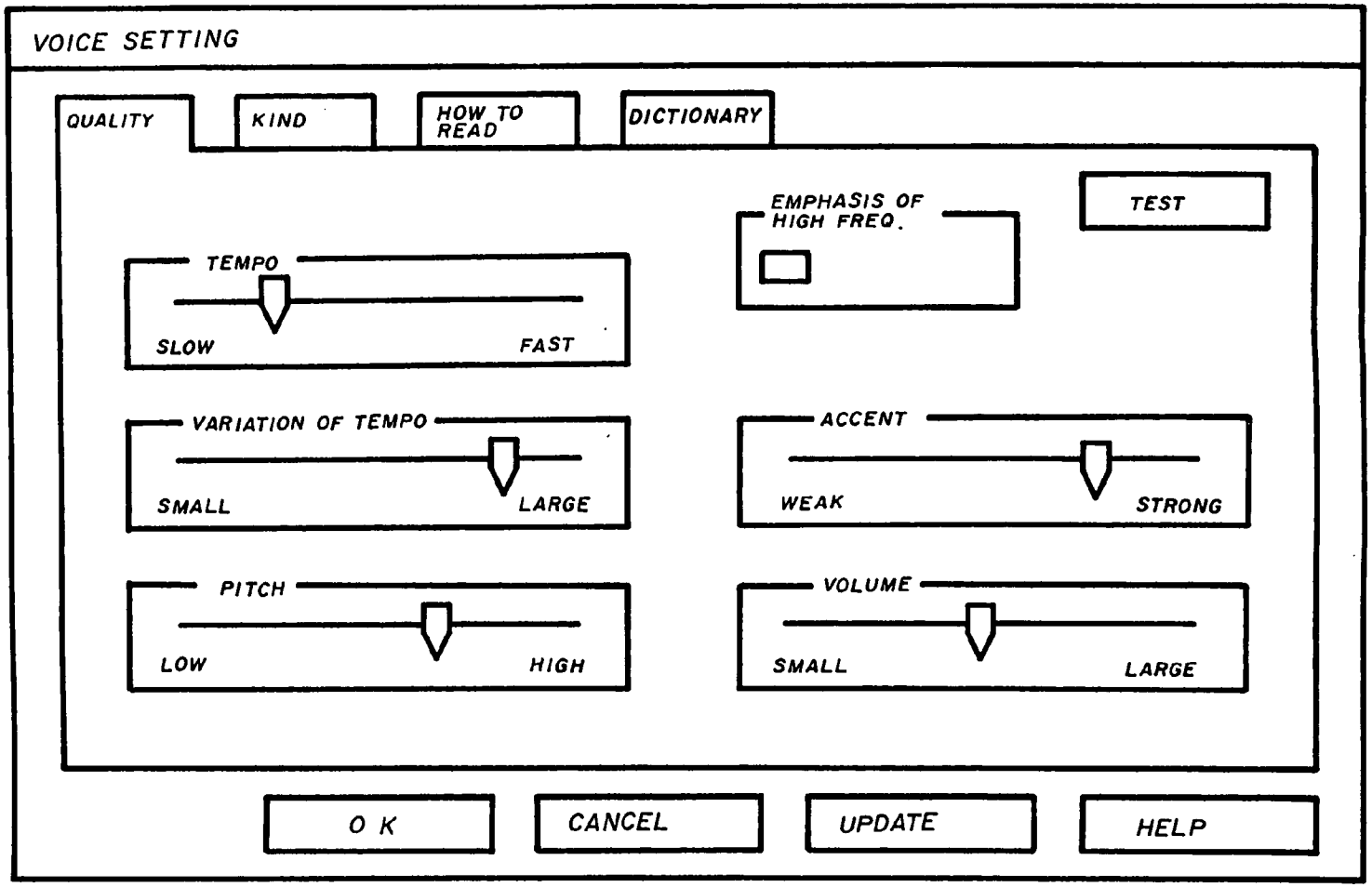
FIG. 25 is a diagram illustrating a setting screen for voice output.

In response to the instruction, the voice synthesis library 32 opens the parameter setting screen as shown in FIG. 25. On the parameter setting screen, the quality of voice, such as a degree of tempo, a degree of variation of tempo, a degree of pitch, emphasis of the high-frequency range, a degree of accent and a degree of volume, is set. The kind of voice, such as a woman's voice or a man's voice, can be set. The manner in which data is read can be set, such as how a sentence is punctuated and how numbers are read. Further, setting can be made as to how to read characters which have not yet been registered in a dictionary of the voice synthesis library 32. In accordance with the parameters set as described above, information can be output in a voice desired by the user.

According to the information processing system, such as, a computer system, described above, the notice information received from the network is displayed and character and symbol information included in the notice information is output by voice. Thus, the user who has an eyesight disorder can hear the contents of the notice information displayed on the screen without operations.

The character symbol information of the notice information is enlarged and displayed. Thus, it is easy for weak eyesight persons to read the notice information displayed on the screen.

Further, character information linked to other information and a file name of image data linked to other information are extracted from the notice information. A list of the extracted information is displayed on the screen and output by voice. Using the list of information, the information to which the notice information is linked can be accessed. The user who has an eyesight disorder can easily access information to which the notice information is linked.

Since the list of the character symbol information liked to the other information is enlarged and displayed on the screen, weak eyesight persons can read the character symbol information to which the notice information is linked.

Furthermore, a list of address information issued in response to a supply request of the notice information is displayed on the screen and output by voice. The user who has an eyesight disorder can easily recognize the address information of the notice information which has been issued.

Since the list of the address information displayed on the screen is enlarged, it is easy for weak eyesight persons to read the list of the address information displayed on the screen.

When the user performs an input operation, the contents of information corresponding to the input operation are output by voice. Thus, people with an eyesight disorder can recognize the contents of the input operation and an operation which should be performed next.

The information processing system according to the present invention overcomes handicaps of people with an eyesight disorder and people having a weak eyesight who wish to use multimedia systems. Further, the present invention can be applied to systems in which mobile terminals and telephones access the internet.

The present invention is not limited to the aforementioned embodiments, and other variations and modifications may be made without departing from the scope of the claimed invention.

What is claimed is:

1. An information processing system which receives notice information having a predetermined format, transmitted via a network, said information processing system enabling access thereto by visually impaired users of the system and comprising:

a World Wide Web ("WWW") browser, which is activated by the information processing system, for receiving the notice information in response to a supply request indicated by a visually impaired user;

obtaining means for obtaining the notice information received by the WWW browser;

storage means for storing the notice information;

extracting means for analyzing the notice information that is obtained and stored in the storage means and extracting character symbol information other than format information included in the notice information based on an analyzing result;

interactive video display means for instantaneously displaying the notice information to the visually impaired user using the analyzing result obtained by said extracting means and for indicating a user selected part of the notice information at a specified position; and voice output means for converting the character symbol information extracted by said extracting means into voice signals and outputting the selected part of the notice information by voice to the visually impaired user based on the voice signals and the user selected part, wherein said extracting means extracts character symbol information having linked address information and stores the extracted character symbol information in the storage means, wherein when the notice information stored in the storage means includes information having linked address information other than character symbol information of image data, said extracting means extract a file name of the image data as character symbol information from the linked address information of the information, and said interactive video display means instantaneously displays a list of character symbol information extracted by said extracting means and said voice output means outputs the list of the character symbol information by voice when a voice output request is made by the visually impaired user for the list of the character symbol information instantaneously displayed by said interactive video display means thereby affording the visually impaired access to the information.

2. The information processing system as claimed in claim 1, wherein said voice output means performs a process for outputting the notice information by voice when a voice output request for the notice information instantaneously displayed by said interactive video display means is issued.

3. The information processing system as claimed in claim 1, wherein said voice output means audibly reads out letters corresponding to typed keyboard characters.

4. The information processing system as claimed in claim 1, wherein when the specified position is a position specified in the list of the character symbol information instantaneously displayed by said interactive video display means, said voice output means outputs character information instantaneously displayed at the specified position by voice.

5. The information processing system as claimed in claim 1, further comprising:

issuance means for specifying linked address information provided in the selected character symbol information and issuing a supply request for the notice information when specific character symbol information is selected from the list of the character symbol information instantaneously displayed by said interactive video display means.

6. The information processing system as claimed in claim 5, wherein said interactive video display means instantaneously displays a screen on which a list of address information specified by said supply request for the notice information, and wherein said voice output means outputs the list of the address information by voice when a voice output request for the fist of the address information instantaneously displayed by said interactive video display means is issued.

7. The information processing system as claimed in claim 6, wherein when a position is specified in the list of the address information instantaneously displayed by said interactive video display means and the voice output request is issued, said voice output means outputs address information instantaneously displayed at the specified position by voice.

8. The information processing system as claimed in claim 1, wherein when an input operation is performed, said voice output means output contents of information corresponding to the input operation by voice.

9. An information processing system which receives notice information having a predetermined format, transmitted via a network, said information processing system enabling access thereto by visually impaired users of the system and comprising:

a World Wide Web ("WWW") browser, which is activated by the information processing system, for receiving the notice information in response to a supply request indicated by a visually impaired user;

obtaining means for obtaining the notice information received by the WWW browser;

storage means for storing the notice information;

extracting means for analyzing the notice information that is obtained and stored by the storage means and extracting character symbol information other than format information included in the notice information based on an analyzing result;

interactive video display means for instantaneously displaying the notice information to the visually impaired user using the analyzing result obtained by said extracting means and for indicating a user selected part of the notice information at a specified position;

voice output means for converting the character symbol information extracted by said extracting means into voice signals and outputting the selected part of the notice information by voice to the visually impaired user based on the voice signals and the user selected part; and setting means for setting a size of character symbol information which is instantaneously displayed on a display screen, wherein said interactive video display means enlarges and instantaneously displays the character symbol information based on the size set by said setting means enabling viewing thereof by the visually impaired user, wherein said display screen includes a first display area to display the character symbol information based on the size set by said setting means; and a second display area to display one line of the character symbol information selected by scrolling upward or downward by a user operation while said voice output means is outputting the one line of the character symbol by voice.

10. The information processing system of claim 1, wherein the notice information is an html document that is intended to be accessible on the WWW via a unique uniform resource locator ("URL").

11. An information processing system which receives notice information having a predetermined format, transmitted via a network, said information processing system enabling access thereto by visually impaired users of the system and comprising:

a World Wide Web ("WWW") browser, which is activated by the information processing system, to receive the notice information in response to a supply request indicated by a visually impaired user;

an obtaining unit to obtain the notice information received by the WWW browser;

a storage area to store the notice information;

an extracting unit to analyze the notice information that is obtained and stored by the obtaining unit and extract character symbol information other than format information included in the notice information based on an analyzing result;

an interactive video display unit to instantaneously display the notice information to the visually impaired user using the analyzing result obtained by said extracting unit and to indicate a user selected part of the notice information at a specified position; and a voice output unit to convert the character symbol information extracted by said extracting unit into voice signals and to output the selected part of the notice information by voice to the visually impaired user based on the voice signals and the user selected part, wherein said extracting unit extracts character symbol information having linked address information and stores the extracted character symbol information in the storage area, wherein when the notice information stored by the obtaining means includes information having linked address information other than character symbol information of image data, said extracting unit extracts a file name of the image data as character symbol information from the linked address information of the information, and wherein said interactive video display unit instantaneously displays a list of character symbol information extracted by said extracting unit and said voice output unit outputs the list of the character symbol information by voice when a voice output request is made by the visually impaired user for the list of the character symbol information instantaneously displayed by said interactive video display unit.

12. The information processing system as claimed in claim 11, wherein said voice output unit performs a process to output the notice information by voice when a voice output request for the notice information instantaneously displayed by said interactive video display unit is issued.

13. The information processing system as claimed in claim 11, wherein said voice output unit performs a process when a position is specified in the notice information instantaneously displayed by said interactive video display unit and a voice output request is issued, the process outputting a part of the notice information instantaneously displayed at the specified position by voice.

14. The information processing system as claimed in claim 11, wherein when the specified position is a position specified in the list of the character symbol information instantaneously displayed by said interactive video display unit, said voice output unit outputs character information instantaneously displayed at the specified position by voice.

15. The information processing system as claimed in claim 11, further comprising:

an issuance unit to specify linked address information provided in the selected character symbol information and issue a supply request for the notice information when specific character symbol information is selected from the list of the character symbol information instantaneously displayed by said interactive video display unit.

16. The information processing system as claimed in claim 15, wherein said interactive video display unit instantaneously displays a screen which lists address information specified by said supply request for the notice intonation, and wherein said voice output unit outputs the list of the address information by voice when a voice output request for the list of the address information instantaneously displayed by said interactive video display unit is issued.

17. The information processing system as claimed in claim 16, wherein when the specified position is a position specified in the list of the address information instantaneously displayed by said interactive video display unit and the voice output request is issued, said voice output unit outputs address information instantaneously displayed at the specified position by voice.

18. The information processing system as claimed in claim 11, wherein when an input operation is performed, said voice output unit output contents of information corresponding to the input operation by voice.

19. An information processing system which receives notice information having a predetermined format, transmitted via a network, said information processing system enabling access thereto by visually impaired users of the system and comprising:

a World Wide Web ("WWW") browser, which is activated by the information processing system, to receive the notice information in response to a supply request indicated by a visually impaired user;

an obtaining unit to obtain the notice information received by the WWW browser;

a storage area to store the notice information;

an extracting unit to analyze the notice information that is obtained by the obtaining unit end stored in the storage area, and to extract character symbol information other than format information included in the notice information based on an analyzing result, and to store the extracted character symbol information in the storage area;

an interactive video display unit to instantaneously display the notice information to the visually impaired user using the analyzing result obtained by said extracting unit and to indicate a user selected part of the notice information at a specified position;

a voice output unit to convert the character symbol information extracted by said extracting unit into voice signals and to output the selected part of the notice information by voice to the visually impaired user based on the voice signals and the user selected part; and a setting unit to set a size of character symbol information which is instantaneously displayed on a display screen, wherein said interactive video display unit enlarges and instantaneously displays the character symbol information based on the size set by said setting unit thereby affording access by the visually impaired to the information, wherein said display screen includes a first display area to display the character symbol information based on the size set by said setting means; and a second display area to display one line of the character symbol information selected by scrolling upward or downward by a user operation while said voice output means is outputting the one line of the character symbol by voice.

20. An information processing system to receive notice information having a predetermined format, transmitted via a network, the information processing system enabling access thereto by visually impaired users of the system, comprising:

a World Wide Web ("WWW") browser, which is activated by the information processing system, to receive the notice information in response to a supply request indicated by a visually impaired user;

an obtaining unit to obtain the notice information received by the WWW browser;

a storage area to store the notice information;

an extracting unit to analyze the notice information that is obtained by the obtaining unit and stored in the storage area and to extract character symbol information other than format information included in the notice information based on an analyzing result;

an interactive video display unit to instantaneously display the notice information to the visually impaired user using the analyzing result obtained by the extracting unit arid to indicate a user selected part of the notice information at a specified position; and a voice output unit to convert the character symbol information extracted by the extracting unit into voice signals and to output the selected part of the notice information by voice to the visually impaired user based on the voice signals and the user selected part, wherein the extracting unit extracts character symbol information having linked address information and stores the extracted character symbol information in the storage area, wherein, when the notice information stored by the obtaining unit includes information having linked address information other than character symbol information of image data, the extracting unit extracts a file name of the image data as character symbol information from the linked address information of the information, wherein the interactive video display unit instantaneously displays a list of character symbol information extracted by the extracting unit and wherein the voice output unit outputs the list of the character symbol information by voice when a voice output request is made by the visually impaired user for the list of the character symbol information instantaneously displayed by the interactive video display unit, thereby affording the visually impaired access to the information.

21. An information processing method to receive notice information having a predetermined format, transmitted via a network, the information processing method enabling access thereto by visually impaired users, comprising:

receiving the notice information in response to a supply request indicated by a visually impaired user;

storing the notice information in a storage area;

analyzing the notice information;

extracting character symbol information other than format information included in the notice information based on an analyzing result;

instantaneously displaying the notice information to the visually impaired user using the analyzing result;

indicating a user-selected part of the notice information at a specified position;

converting the extracted character symbol information into voice signals;

outputting the selected part of the notice information by voice to the visually impaired user based on the voice signals and the user selected part, wherein the extracted character symbol information has linked address information, wherein, when the stored notice information includes information having linked address information other than character symbol information of image data, a file name of the image data as character symbol information from the linked address information of the information is extracted;

instantaneously displaying a list of extracted character symbol information; and outputting the list of the character symbol information by voice when a voice output request is made by the visually impaired user for the list of the character symbol information instantaneously displayed thereby affording the visually impaired access to the information.

22. A computer network implemented information processing system which receives information transmitted over said network, said information enabling access thereto by visually impaired users of the system and comprising:

a network browser receiving information in response to a request indicated by the visually impaired user;

a memory storing information;

a selection unit analyzing information and selecting character symbol information other than format information;

an interactive display instantaneously displaying information to the visually impaired user using an analyzing result obtained by said selection unit and for indicating a user selected part of the information at a specified position;

a voice output unit outputting the selected part of the information by voice to the visually impaired, wherein said selection unit selects character symbol information having linked address information and stores the character symbol information in memory, wherein when the notice information stored in memory includes information having linked address information other than character symbol information of image data, said selection unit selects a file name of the image data as character symbol information from the linked address information of the information, and said interactive display instantaneously displays a list of character symbol information selected by said selection unit and said voice output unit outputs the list of the character symbol information by voice when a voice output request is made by the visually impaired user thereby affording the visually impaired access to the information.

23. The computer network implemented information processing system of claim 22, further comprising a size adjusting unit adjusting the size of character symbol information which is instantaneously displayed on said interactive display, wherein said interactive display increases and instantaneously displays the character symbol information based on the size adjusted by said adjusting unit.

24. The computer network implemented information processing system of claim 23, wherein said interactive display includes a first display area to display the character symbol information based on the size adjusted by said adjusting unit; and a second display area to display one line of the character symbol information selected by scrolling upward or downward by a user operation while said voice output means is outputting the one line of the character symbol by voice.

* * * * *

UNITED STATES PATENT AND TRADEMARK OFFICE

CERTIFICATE OF CORRECTION

PATENT NO. : 6,996,533 B2
APPLICATION NO. : 08/991881
DATED : February 7, 2006
INVENTOR(S) : Keiichi Ikeda et al.

It is certified that error appears in the above-identified patent and that said Letters Patent is hereby corrected as shown below:

First Page, Column 1 (Inventors), Line 1, delete “Obihiro” and insert - - Hokkaido - - therefor.
First Page, Column 1 (Inventors), Line 2, delete “Obihiro” and insert - - Hokkaido - - therefor.
First Page, Column 2 (Foreign Patent Documents), Line 1, after “11/1991” insert - - GO6k 11/18 - -.
First Page, Column 2 (Other Publications), Line 1, delete “stephens” and insert - - Stephens - - therefor.
First page, Column 2 (Other Publications), Line 1, delete “Scientis,” and insert - - Scientist, - - therefor.
Column 13, Line 21, delete “extract” and insert - - extracts - - therefor.
Column 13, Line 63, delete “fist” and insert - - list - - therefor.
Column 15, Line 67, delete “intonation” and insert - - information - - therefor.
Column 16, Line 30, delete “end” and insert - - and - - therefor.
Column 17, Line 14, delete “arid” and insert - - and - - therefor.
Column 17, Line 33, delete “unit” and insert - - unit, - - therefor.
Column 17, Line 54, delete “user-selected” and insert - - user selected - - therefor.

Signed and Sealed this

Twenty-second Day of August, 2006

JON W. DUDAS
*Director of the United States Patent and Trademark Office*